US005810843A

United States Patent [19]

Iwasaki et al.

[11] Patent Number: 5,810,843

[45] Date of Patent: Sep. 22, 1998

[54] HAND-HELD DEPILATING DEVICE

[75] Inventors: Jyuzaemon Iwasaki, Nagahama; Masao Tanahashi; Yoshinobu Takegawa, both of Hikone; Mika Asada, Matsubara, all of Japan

[73] Assignee: Matsushita Electric Works, Ltd, Osaka, Japan

[21] Appl. No.: 697,521

[22] Filed: Aug. 26, 1996

[30] Foreign Application Priority Data

| | | | |
|---|---|---|---|
| Aug. 28, 1995 | [JP] | Japan | 7-219116 |
| Oct. 3, 1995 | [JP] | Japan | 7-256575 |
| May 15, 1996 | [JP] | Japan | 8-120693 |

[51] Int. Cl.[6] ..... A61B 17/50

[52] U.S. Cl. ..... 606/133; 606/131

[58] Field of Search ..... 606/133, 131, 606/43, 42, 36–41, 51–52, 46, 45, 47–50; 601/68–70

[56] References Cited

U.S. PATENT DOCUMENTS

| | | | |
|---|---|---|---|
| 919,649 | 4/1909 | Sciple | 601/68 |
| 5,011,485 | 4/1991 | Dear et al. | 606/133 |
| 5,078,715 | 1/1992 | Daar et al. | 606/133 |
| 5,346,499 | 9/1994 | Garenfeld et al. | 606/133 |
| 5,356,415 | 10/1994 | Iwasaki et al. | 606/133 |
| 5,494,485 | 2/1996 | Gabion et al. | 606/133 |
| 5,611,804 | 3/1997 | Heintke et al. | 606/133 |

FOREIGN PATENT DOCUMENTS

| | | |
|---|---|---|
| 467 733 A1 | 1/1992 | European Pat. Off. . |
| 0 493 849 | 8/1992 | European Pat. Off. . |
| 0 622 033 | 1/1994 | European Pat. Off. . |
| 596 283 A1 | 5/1994 | European Pat. Off. . |
| 596283 | 5/1994 | European Pat. Off. . |
| 622 033 A2 | 11/1994 | European Pat. Off. . |
| 3-178603 | 8/1991 | Japan . |
| WO 93/0969 | 5/1993 | WIPO . |

*Primary Examiner*—Michael A. Brown
*Assistant Examiner*—Justine R. Yu
*Attorney, Agent, or Firm*—Nikaido, Marmelstein, Murray & Oram LLP

[57] ABSTRACT

A hand-held depilating device capable of masking the pain of plucking the hairs through psychological effect. The depilating device comprises housing adapted to be grasped by the hand of the user and a plucking head mounted on top of the housing for plucking the hairs from the skin. Stimulator is mounted on top of the housing adjacent to the plucking head for providing mechanical stimuli to the skin while the plucking head operates to pluck the hairs. The stimulator comprises a vibrator which provides vibrations to the skin as the mechanical stimuli which act on sense receptors other than nociceptors that respond to pain, thereby masking the pain caused by plucking the hairs or received at the nociceptors. That is, the mechanical stimuli caused by the vibrations can activate Meissner's corpuscle or Pacinian corpuscle to make indistinct to the pain as demonstrated by a gate-control theory in psychology. Thus, the mechanical stimuli applied separately from the plucking operation can excite the tactile or pressure sense receptors so as to activate the gate control path at posterior horn of the spinal cord immediately before or simultaneously with the plucking the hair, thereby blurring the pain being transmitted through the nerve. Alternately, roller with stimulus projections may be utilized to apply the mechanical stimuli for alleviation of the pain.

23 Claims, 26 Drawing Sheets

132
131
38
33
39
36
33
30
35
34
38
36
130
25
37
22
31
39
35
23
24
20
21
69
43
41
40
69
49
141
42
44-1
44-2
46-1
46-2
47
45
52
53
50-2
50-1
53

HAND-HELD DEPILATING DEVICE

BACKGROUND OF THE INVENTION

1. Field of the Invention

The present invention is directed to a hand-held depilating device for plucking hairs from the skin of a user, and more particularly to such device having a stimulator providing mechanical stimuli to the skin for masking the pain of plucking the hairs.

2. Description of the Prior Art

U.S. patent application U.S. Pat. No. 5,356,415 discloses a depilating device which comprises a plucking head for plucking the hairs from the skin of a user and a smooth roller which is mounted separately from the plucking head to be in rolling contact with the skin around a portion from which the hairs are plucked by the plucking head. The roller acts to stretch the skin for alleviating pain by the effect of reducing resistance to a force of pulling the hairs. However, even with the skin stretching, there remains a problem that the pain itself may be perceived still significantly by the user.

SUMMARY OF THE INVENTION

In order to further alleviate the pain experienced at the time of plucking the hairs, the inventors study mechanism of pain including nerve systems as well as sense receptors in the skin. Through this study, it is found effective to give mechanical stimuli to the skin in order to considerably alleviate the pain caused by plucking the hairs. The present invention is accomplished based upon the above finding and comprises a depilator housing adapted to be grasped by the hand of the user and a plucking head mounted on top of the housing for plucking the hairs from the skin. Stimulator is mounted on top of the housing adjacent to the plucking head for providing mechanical stimuli to the skin while the plucking head operates to pluck the hairs. The stimulator comprises a vibrator which provides vibrations to the skin as the mechanical stimuli. The vibrations can act on sense receptors other than nociceptors that respond to pain, thereby masking the pain caused by plucking the hairs or received at the nociceptors. That is, the mechanical stimuli caused by the vibrations can activate Meissner's corpuscle or Pacinian corpuscle to make indistinct to the pain as demonstrated by a gate-control theory in psychology. Therefore, the mechanical stimuli applied separately from the plucking operation can excite the tactile or pressure sense receptors so as to activate the gate control path at posterior horn of the spinal cord immediately before or simultaneously with the plucking the hair, thereby blurring the pain being transmitted through the nerve. Further, the mechanical stimulus of vibrating nature do hardly act to rub the skin so as to assure comfortable hair plucking without causing unpleasant skin rubbing which may hurt the skin.

Accordingly, it is a primary object of the present invention to provide a hand-held depilating device which applies the vibrations to the skin during the plucking operation for effectively alleviating the pain caused by plucking the hair.

The vibrator may comprise a vibration roller which is rotatably supported to the top of the housing and is driven by an incorporated motor to rotate. The vibration roller has a rotation axis which is eccentric from a mass center of the roller so that, as the vibration roller is driven to rotate while moving the plucking head across the skin, the vibration roller generates vibrations which are applied to the skin. Thus, the vibratory mechanical stimuli can be generated with a simple eccentric structure, which is therefore another object of the present invention.

The vibrator is preferred to vibrate in a direction perpendicular to a general surface of the skin for giving the mechanical stimuli effectively to the skin, which is therefore a further object of the present invention.

The vibrator is carried on a skin guide frame which is floatingly supported to the housing together with the plucking head so that the vibrator can easily follow the various portions of the skin while manipulating the plucking head thereacross. With this result, the mechanical stimuli can be applied effectively and uniformly to the skin, which is therefore a still further object of the present invention.

Further, the ski guide frame is supported to be capable of swinging about a swing axis while it is depressed together with the plucking head. With the combination of the depressing and swinging movements of the skin guide frame relative to the housing, the vibrator on the skin guide frame can easily follow the various portions of the skin while manipulating the plucking head thereacross. Thus, the mechanical stimuli can be applied effectively and successfully to the skin. In order to achieve such sophisticated movement, the skin guide frame is engaged on a rounded portion of the housing at a point of contact defining the swing axis. As the skin guide frame swings with an attendant depression thereof, the point of contact is made to move along the rounded portion.

The housing is preferred to have a restrictor which is associated with the vibrator to restrict an effect or extent of vibration to be applied to the skin. The restrictor is positioned immediately adjacent to the vibrator and comes into contact with the skin together with the vibrator so as to restrict an extent to which the vibrator is pressed against the skin. Therefore, the vibration of an optimum amplitude can be applied to the skin. The restrictor is connected to variably adjust the effect of the vibration or adjust the amplitude of the vibration to be transmitted to the skin in accordance with varying locations of the skin or the user's preference for maximizing the effect of alleviating the pain, which is therefore a further object of the present invention.

The vibrator may includes a skin contact member or applicator which is detachable to the vibrator. With the use of a plurality of skin contact members of different stimulating characteristics, the user can select one of the skin contact members which is optimum for each individual user or for different portions of the skin.

In another embodiment of the present invention, the stimulator comprises a roller with a plurality of stimulus projections which provide the mechanical stimuli to the skin as the roller is caused to rotate in contact with the skin. The mechanical stimuli thus produced separately from the plucking operation can excite the tactile or pressure sense receptors so as to mask the pain caused by plucking the hair in the same manner as discussed hereinbefore. As the plucking head is manipulated across the skin, the roller is caused to rotate so that the stimulus projections apply the mechanical stimulus. In this manner, the mechanical stimuli can be obtained with a simple mechanism of using the roller, which is therefore a further object of the present invention.

The stimulus projections are preferably in the form of bristles projecting radially from the roller.

Preferably, the roller is carried on a skin guide frame which is floatingly supported to the housing so that the stimulus projections on the roller can easily follow the various portions of the skin while manipulating the plucking head thereacross. With this result, the mechanical stimuli can be applied effectively to the skin, which is therefore a still further object of the present invention.

An adjusting mechanism is provided to adjust a projection amount of the stimulus projections from the top of the housing so that the user can select optimum mechanical stimulus for alleviating the pain. In addition, the roller may be detachably mounted to the housing so that it can be replaced with another roller of different stimulating characteristic. Thus, the user can select optimum stimulation effect for various portions of skin and for her own preference, which is therefore a further object of the present invention.

In a preferred embodiment, the plucking head is floatingly supported to the housing to be capable of being depressed and is surrounded by a skin guide frame. The skin guide frame comprises a main body which is connected to the plucking head to be capable of being depressed together therewith and a front guide which is movably supported to the main body for limited displacement relative to the main body. The roller is supported to the front guide so that the roller can be depressed for a limited extent independently of the plucking head after which it can be depressed together with the plucking head. In this manner, the roller can well follow the contour of the skin while manipulating the plucking head thereacross, thereby enhancing the effect of the mechanical stimuli for alleviation of the pain, which is therefore a further object of the present invention.

Further, the skin guide frame is supported to be swingable about a swing axis while it is depressed together with the plucking head. With the combination of the depressing and swinging movements of the skin guide frame relative to the housing, the roller on the skin guide frame can follow the skin more precisely while manipulating the plucking head thereacross. Thus, the mechanical stimuli can be applied effectively and successfully to the skin for further enhancing the alleviation of the pain. In order to achieve such sophisticated movement, the skin guide frame is engaged on a rounded portion of the housing at a point of contact defining the swing axis. As the skin guide frame swings, the point of contact is made to move along the rounded portion of the housing in a direction of facilitating an attendant depression of the skin guide frame together with the plucking head. Thus, the roller carried on the skin guide frame can follow the skin more conformably to achieve superior effect of alleviating the pain.

These and still other objects and advantageous features of the present invention will become more apparent from the following description of the embodiments when taken in conjunction with the attached drawings.

BRIEF DESCRIPTION OF THE DRAWINGS

FIGS. 31A and 3lB are perspective and sectional views of a third alternative roller which may be utilized in the above depilating device;

DETAILED DESCRIPTION OF THE EMBODIMENTS

First Embodiment <FIGS. 1 to 13>

Figure 1:
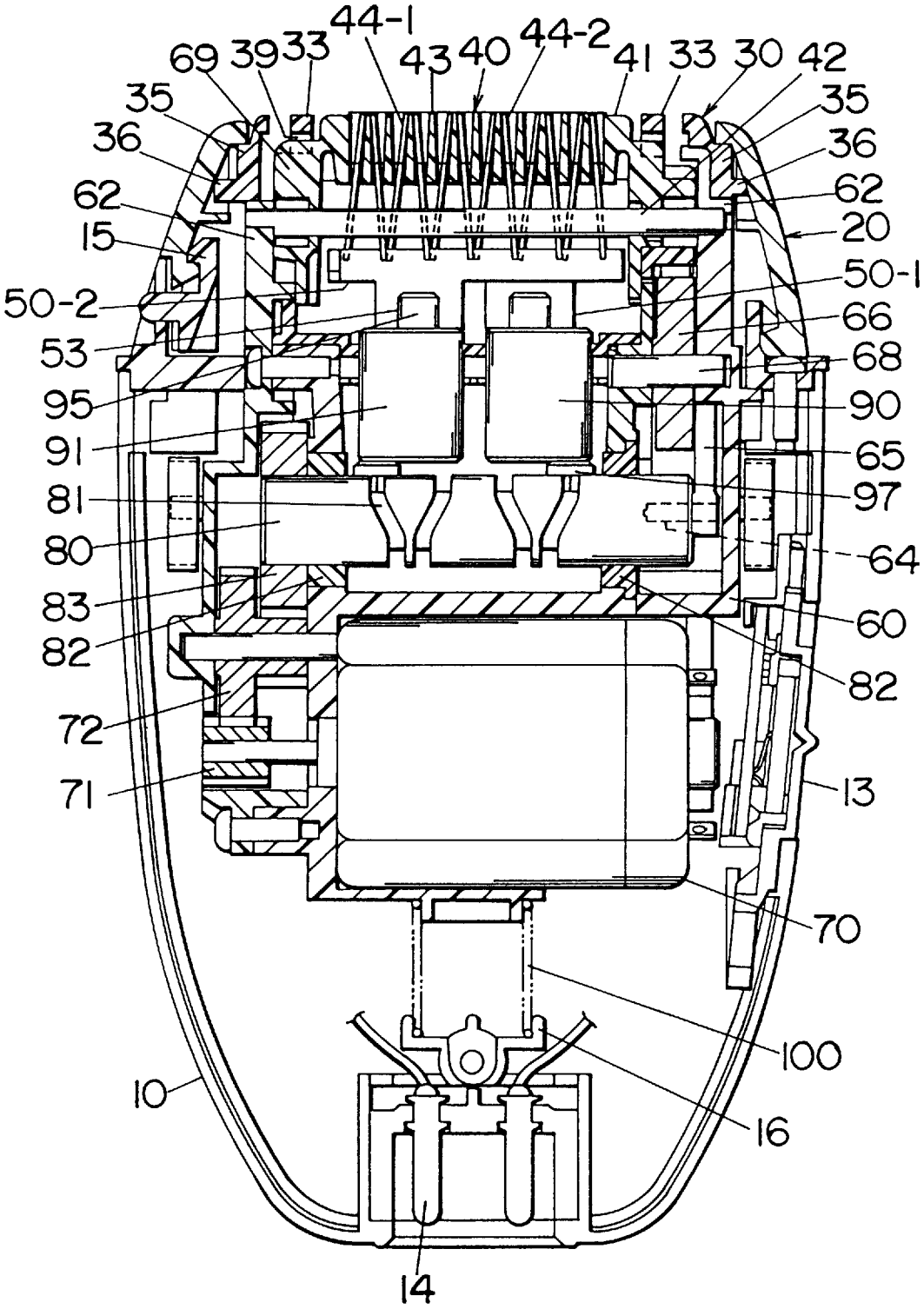
FIG. 1 is a front vertical section of a depilating device in accordance with a first embodiment of the present invention.
Figure 2:
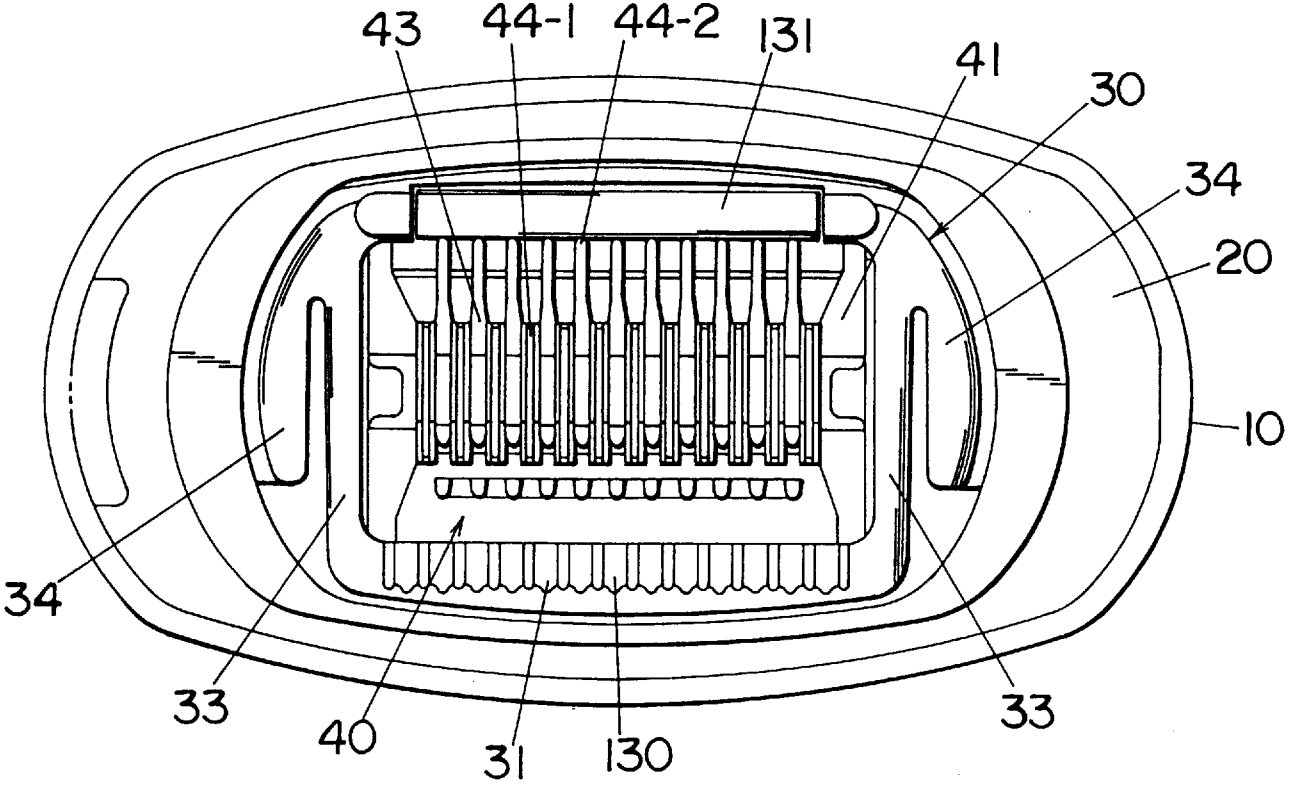
FIG. 2 is a top view of the depilating device.
Figure 3:
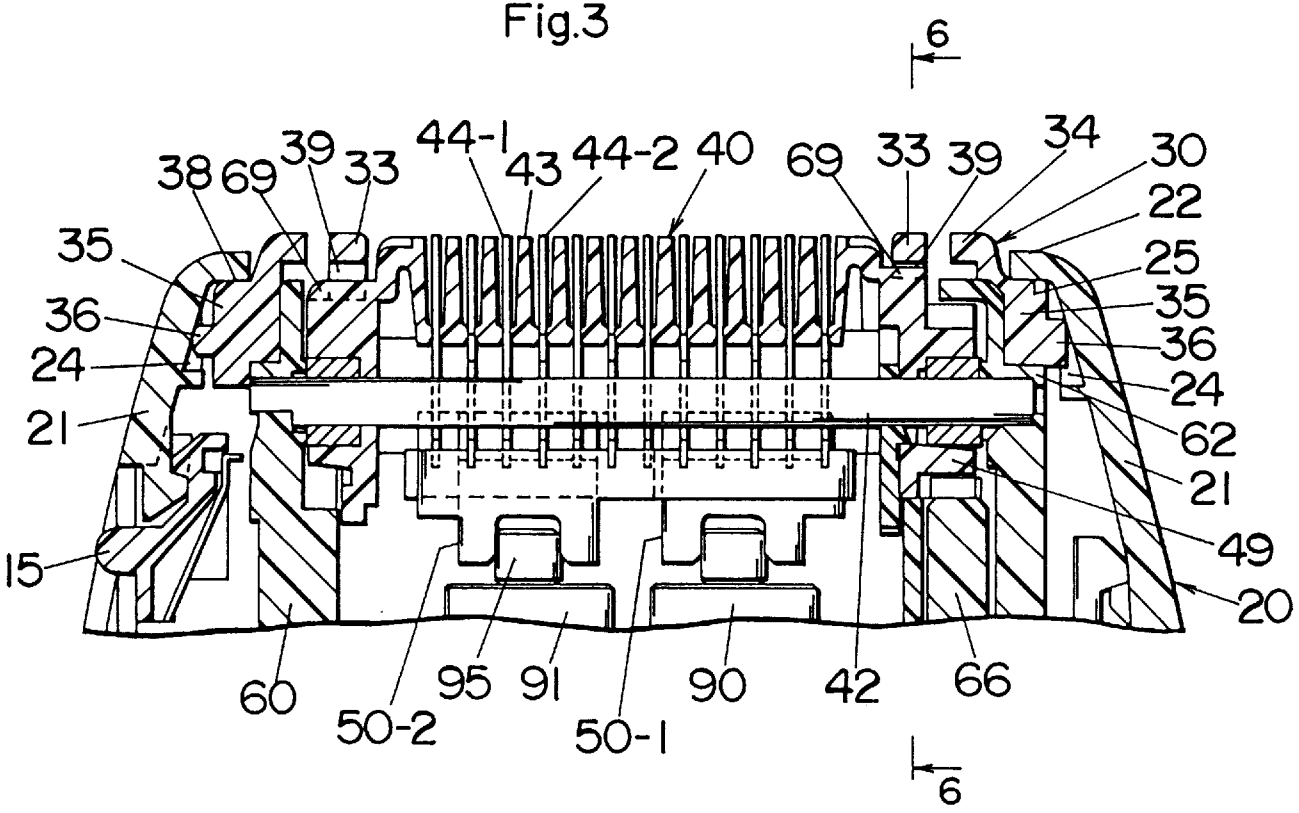
FIG. 3 is front vertical section of a plucking head of the device.
Figure 4:
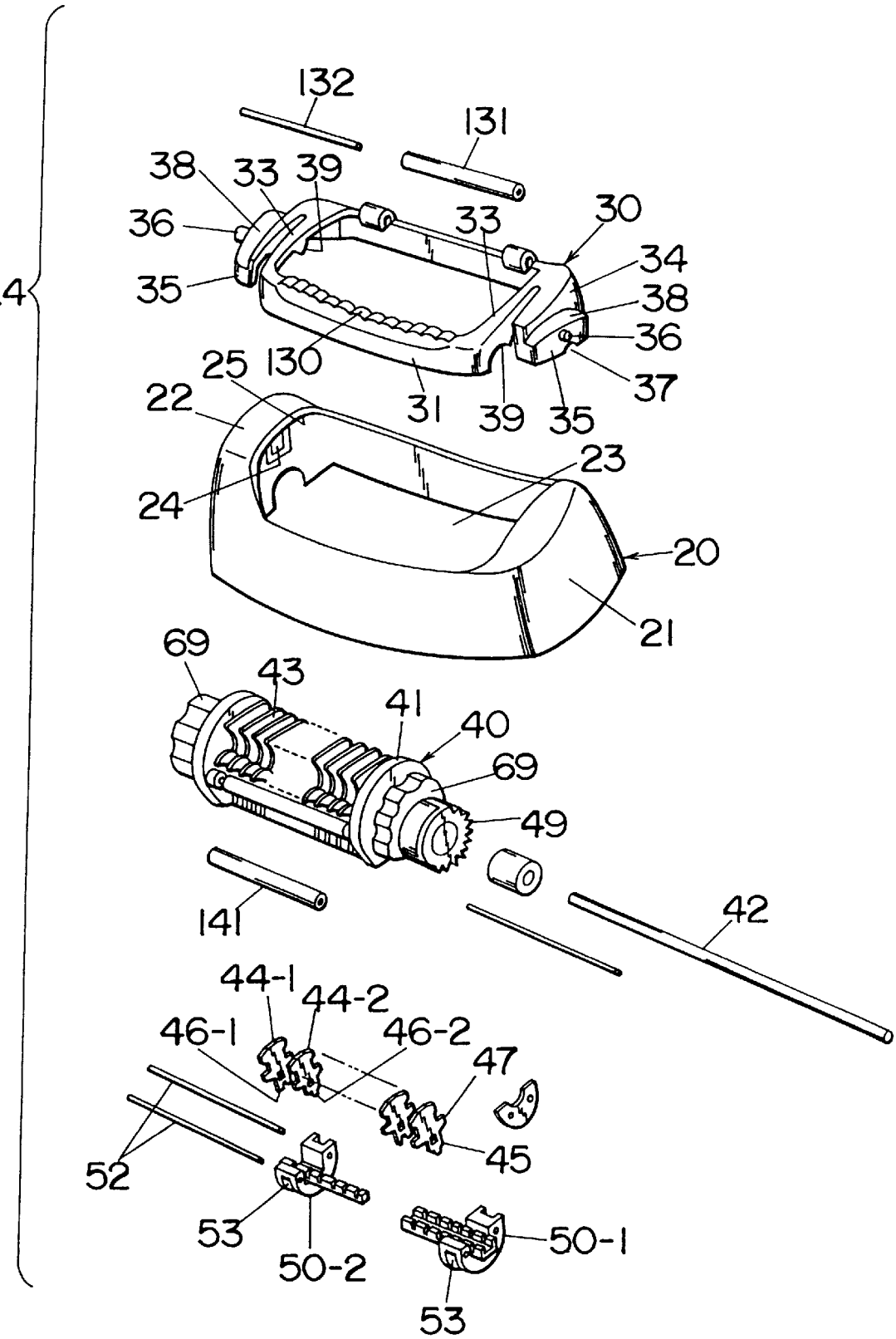
FIG. 4 is an exploded perspective view of the plucking head and a skin guide frame.

Referring to FIG. 1, there is shown a depilating device in accordance with a first embodiment of the present invention. The device comprises a housing 10 mounting a head frame 20 with a generally rectangular opening and a plucking head 40 disposed within the head frame 20 to be exposed through the opening. The housing 10 incorporates a chassis 60 mounting a motor 70, a positive return cam 80, and a drive mechanism for the plucking head 40. The housing 10 is provided with a power switch 13 for turning on and off the motor 70 and also with a pair of terminal pins 14 for electrical connection to an AC power adapter to energize the motor 70. As best shown in FIG. 4, the head frame 20 is in the form of a top and bottom opened rectangular frame having a pair of end walls 21 between which the plucking head 40 is received. The head frame 20 is detachably mounted on the upper end of the housing 10 by means of a hook 15 and carries a skin guide frame 30 which comes into contact with the skin of the user for guiding the plucking head 40 across the skin.

The plucking head 40 comprises a carrier 41 rotatably supported about a shaft 42 which extends horizontally between the upper ends of the chassis 60 to define a longitudinal axis of the plucking head. The carrier 41 is is formed with a series of fixed pinching blades 43 of an arcuate configuration arranged along the longitudinal axis. The fixed pinching blades 43 are made of a plastic material having some elasticity and are molded integrally with the carrier 41 to provide a unitary structure. Mounted on the carrier 41 are movable pinching blades 44-1 and 44-2 which are arranged along the axis of the shaft 42 in an alternating relation to the fixed pinching blades 43. The movable pinching blades 44-1 and 44-2 are commonly supported loosely on the shaft 42 to be rotatable thereabout together with the carrier 41 and the fixed pinching blades 43. The movable pinching blades 44-1 and 44-2 are arranged along the axis of the shaft 42 alternately to each other and are secured at their lower ends respectively to first and second sliders 50-1 and 50-2 which are slidably supported by axles 52 held in the lower end of the carrier 41 and which are driven to reciprocate in parallel with the shaft 42 but in the opposite directions to each other, as will be discussed later. The movable pinching blades 44-1 and 44-2 are formed at their ends respectively with a pair of spaced anchor legs 46-1 and a single anchor leg 46-2 which are press-fitted to corresponding notches formed in the sliders 50-1 and 50-2, respectively. Each of the movable pinching blades 44-1 and 44-2 are also formed to have a pair of side tabs 47 on the opposite sides of a hole 45 through which the shaft 42 extends. The side tabs 47 are press fitted to corresponding grooves formed in the carrier 41 so that the movable pinching blades are allowed to swing about the individual connections of the side tabs 47 with the grooves toward and away from the adjacent fixed pinching blades 43 as the anchor legs 46 are caused to move axially by the reciprocation of the sliders 50-1 and 50-2. Thus, the movable pinching blades are driven to swing or to have the upper edges displaced axially toward and away from the adjacent fixed pinching blades 43 so as to repeat clamping the hairs between the movable and fixed pinching blades and releasing the hairs for plucking the hairs in association with an oscillatory movement of the carrier 41 about the shaft 42, the detail of which will be discussed later.

Referring back to FIG. 1, the chassis 60 supports a plurality of gears for establishing a drive connection from the motor 70 to the positive-return cam 80 as well as for oscillating the carrier 41, i.e., the plucking head 40 about the shaft 42. The positive-return cam 80 is provided in the form of a cylinder with a pair of circumferentially extending grooves 81 which are symmetrical to each other such that the horizontal distance between the grooves varies in the circumferential direction. The cam 80 is journaled at its opposed ends by means of bearings 82 in the chassis 60 to be rotatable about a horizontal axis and is operatively connected to the sliders 50-1 and 50-2 by means of cam cylinders 90. The cam cylinder 90 comprises a barrel 91 supported to the chassis 60 by means of a vertical pin (not shown) to be rotatably about a vertical axis. Projecting upwardly from the barrel 91 is a pin 95 which is slidably received in an arcuate furrow 53 formed in the bottom of each of the sliders 50-1 and 50-2. The barrel 91 is also provided on its lower end with a cam follower 97 for slidable engagement into each one of grooves 81 of the cam 80 such that the rotation of the cam 80 is translated into reciprocating movement of the sliders 50-1 and 50-2 along the shaft 42 through a swinging movement of the cam cylinders 90, thereby displacing the movable pinching blades 44-1 and 44-2 in the axial direction to move their upper edge into abutment and away from the associated fixed pinching blades 43.

Thus, the rotation of the cam 80 causes the sliders 50-1 and 50-2 to reciprocate along the axis of the shaft 42 in opposite directions, thereby displacing a set of alternate movable pinching blades 44-1 in the same direction and at the same time displacing the other alternate set of the movable pinching blades 44-2 in the opposite direction. In this marmer, every set of two adjacent movable pinching blades 44-1 and 44-2 are caused to swing in the opposing directions to have their upper edges abutted against on both sides of the common fixed pinching blade 43 located between the two adjacent movable pinching blades 44-1 and 44-2 in order to clamp the hairs therebetween.

As shown in FIG. 1, the motor 70 is operatively connected to the cam 80 through a reduction gear train of a pinion 71 of the motor 70, a first gear 72 and a second gear 83 fixed on one end of the cam 80. The cam 80 is linked to one end of a crank lever 65 by means of an eccentric pin 64 which is eccentric to the horizontal axis of the cam 80. The other end of the crank lever 65 is coupled to a partially toothed rack wheel 66 by means of a pivot pin (not shown) which is eccentric to a shaft 68 carrying the rack wheel 66. The rack wheel 66 is in meshing engagement with a gear 49 on one axial end of the carrier 41 so that the rotation of the eccentric pin 64 about the axis of the cam 80 is translated into an oscillating rotary movement of the rack wheel 66 about the shaft 68 and therefore the corresponding movement of the gear 49 or the plucking head 40 about the shaft 42. That is, the plucking head 40 is caused to oscillate about the shaft 42 in synchronism with the plucking movement of displacing the movable pinching blades in the axial direction of the shaft 42, and is so arranged as to complete one oscillation cycle while the cam 80 rotates one rotation about its horizontal axis such that the movable pinching blade is caused to move toward and away from one of the two adjacent fixed pinching blades during one oscillation cycle of the plucking head 40 about the shaft 42 and to move toward and away from the other fixed pinching blade during subsequent oscillation cycle of the plucking head 40. More detailed operation of the plucking head 40 is explained in the European Patent Application No. 92102760.3 and therefore is omitted herein. However, it is noted here that the plucking head 40 is driven to oscillate about its longitudinal axis between a limited angular range such that the clamping edges of the pinching blades are caused to advance into the opening of the head frame 20 and retard inwardly into the head frame 20, during which swinging movement the hairs are plucked as being clamped between the adjacent pinching blades.

The plucking head 40 is disposed at the upper end of the head frame 20 together with the skin guide frame 30 so as to define an advancing direction along which the guide frame 30 is moved by the user in contact with the skin for successively plucking the hairs over a wide area of the skin. The advancing direction is defined to be perpendicular to the longitudinal axis of the plucking head 40 and correspond to a forward angular movement of the plucking head 40 about its longitudinal axis in which the clamping edges of the pinching blades swings about the longitudinal axis outwardly for entrapping the hairs between the movable and fixed pinching blades. That is, when moving the skin guide frame 30 in contact with the skin in the advancing direction, the plucking head 40 will follow that direction as moving forward from the behind in circumferential direction about the longitudinal axis of the plucking head 40. The plucking head 40 is additionally provided with a smooth roller 141 which extends in parallel with the longitudinal axis of the plucking head and is located forwardly of the pinching blades with respect to a direction of moving the pinching blades into contact with the skin from the inwardly retracted position, such that the roller 141 comes into contact with the skin for smoothing the skin prior to plucking the hairs therefrom.

The plucking head 40 is mounted on the chassis 60 together with the motor 70 as well as the other components establishing the driving connection therebetween so that almost all of the components are integrated into a single unit The chassis 60 is floatingly supported within the housing 10 by means of a coil spring 100 so that the plucking head 40 can be depressed inwardly into the housing 10 to a limited extent and therefore can readily follow the contour of the skin without accompanying an excessive counter-force to the plucking head 40 when pressing the head 40 to the skin. As seen in FIG. 1, the coil spring 100 is interposed between the lower end of the chassis 60 and a stand 16 on the interior of the housing 10. The upward displacement of the chassis 60 is limited by engagement of a stopper on the chassis 60 with a corresponding part of the housing 10.

Figure 5:
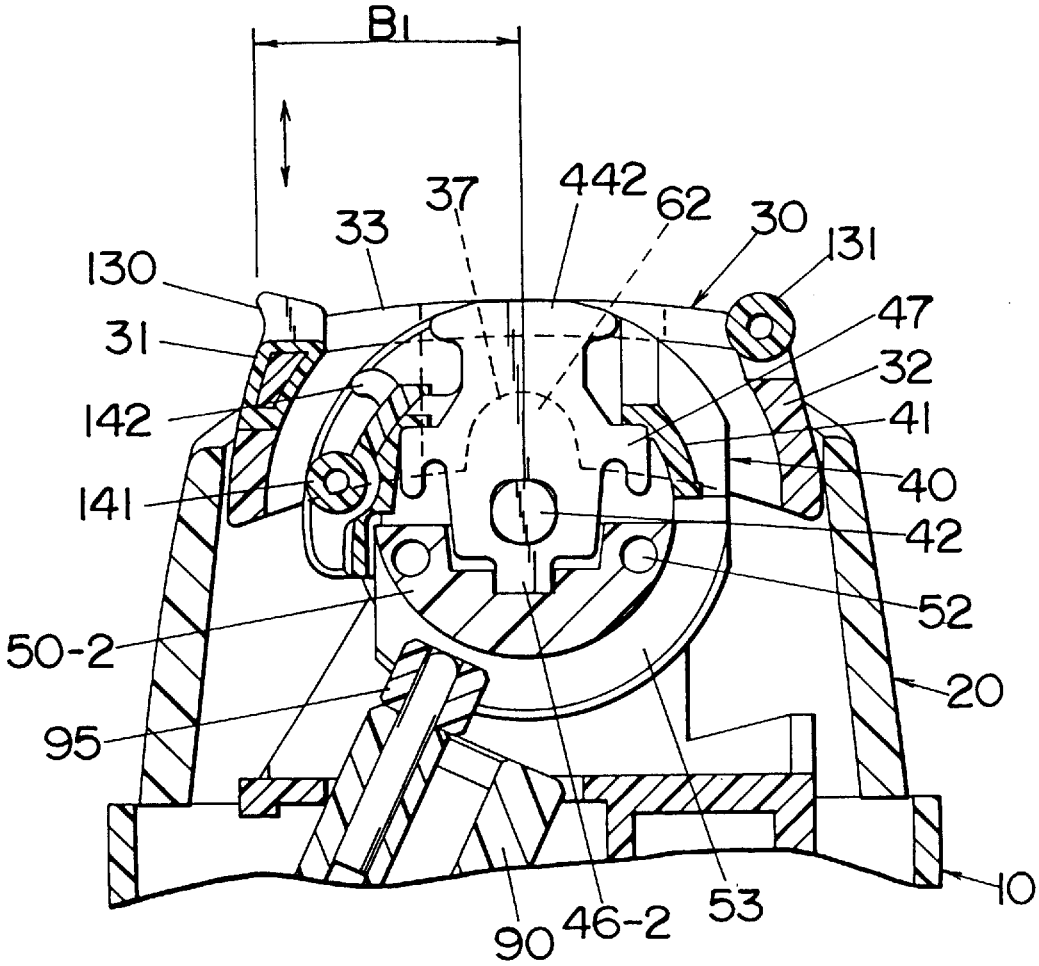
FIG. 5 is a side section of the plucking head and the skin guide frame.

The skin guide frame 30 is disposed around the plucking head 40 for contact with the skin in order to smoothly guide the plucking head when moving the plucking head in the advancing direction. As shown in FIG. 4, the skin guide frame 30 is made of a plastic material into a unitary structure of a generally rectangular configuration having a pair of front and rear bars 31 and 32 integrally connected by opposite end bars 33. Each of the opposite end bars 33 is connected at its rear end integrally with a rigid end support 34. The end bar 33 is made thin to give a sufficient resiliency by which the front bar 31 is allowed to move substantially vertically relative to the end supports 34 with attendant resilient deformation of the end bars 33, The guide frame 30 is fitted within the head frame 20 by loose engagement of pins 36 on the end supports 34 into corresponding vertical grooves 24 in the inner surface of the end walls 21 of the head frame 20 in such a manner that the guide frame 30 is vertically movable relative to the head frame 20. The end support 34 is formed integrally with bearing projection 35 from which the pin 36 projects. The bearing projection 35 has in its lower end with a recess 37 into which a shoulder 62 at the upper end of the chassis 60 engages, as shown in FIGS. 1 and 5, such that the guide frame 30 can be depressed together with the chassis 60, or the plucking head 40. In other words, the guide frame 30 is floatingly supported together with the plucking head 40 by the coil spring 100, so that the guide frame 30 and the plucking head 40 can be depressed together relative to the housing 10.

Figure 6A:
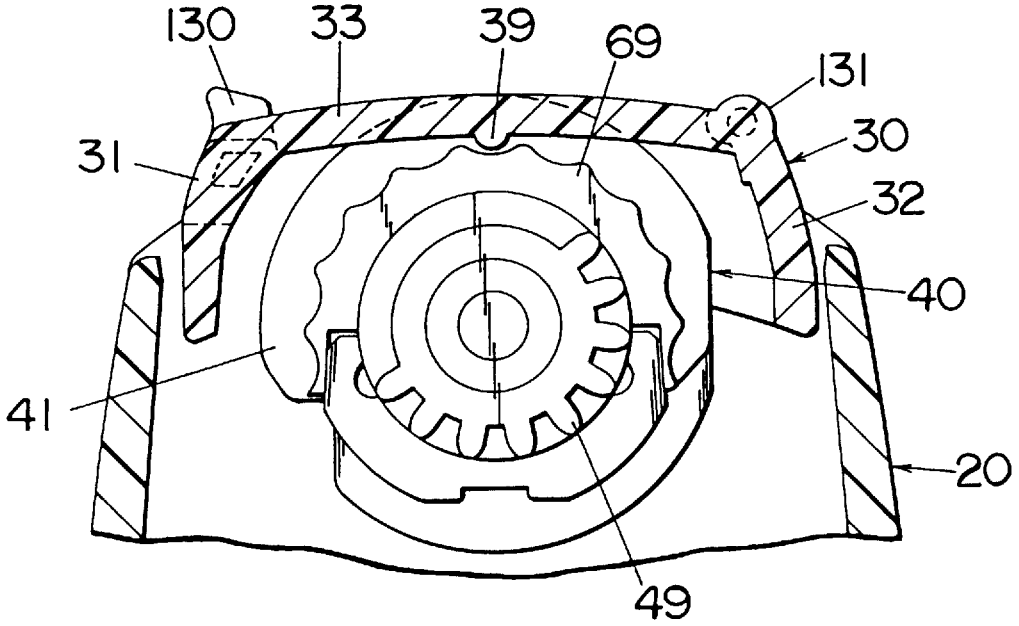
FIGS. 6A and 6B show a mechanism of driving a vibrator defined in the skin guide frame as viewed in a section taken along a line 6—6 of FIG. 3.
Figure 6B:
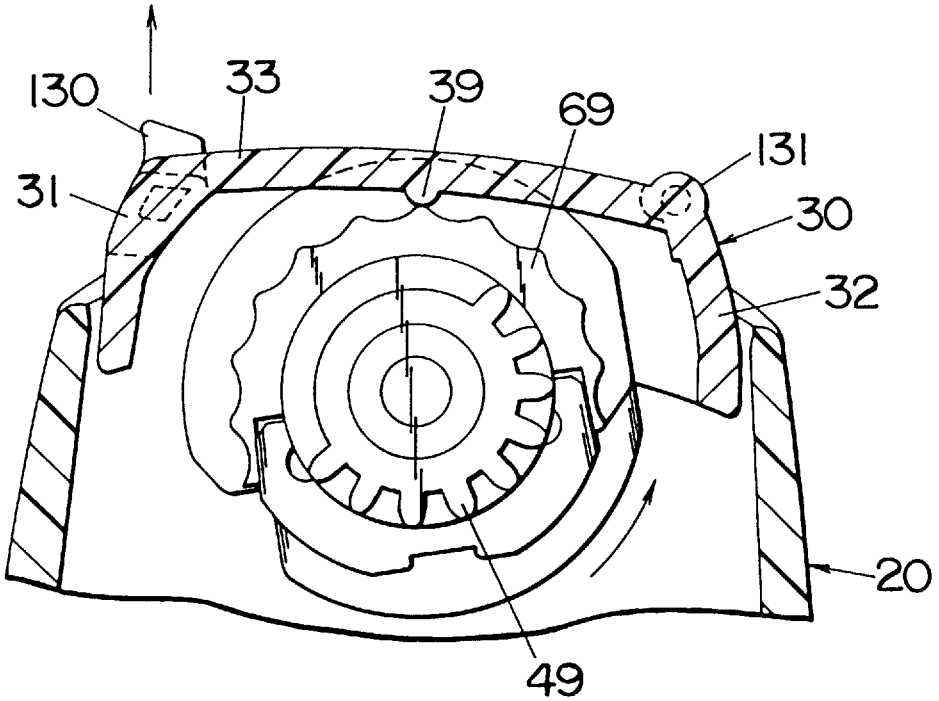
Figure 7A:
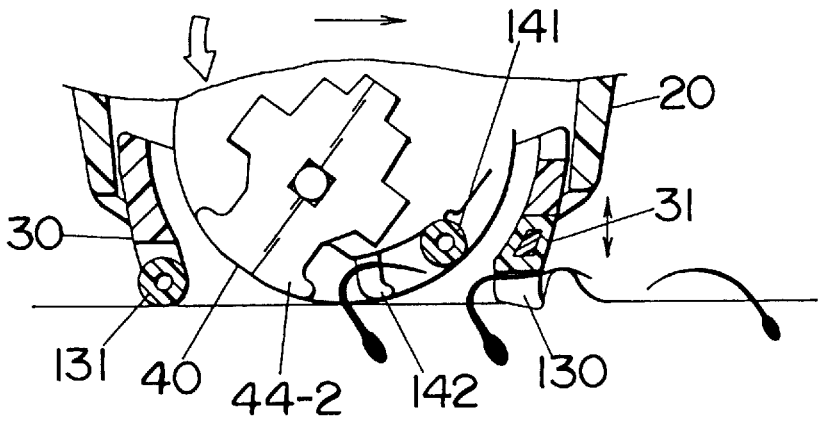
FIGS. 7A, 7B, and 7C show a hair plucking operation with the aid of the vibrator.
Figure 7B:
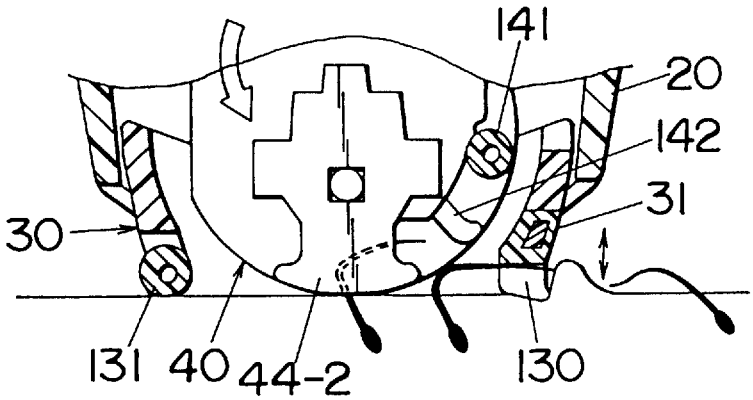
Figure 7C:
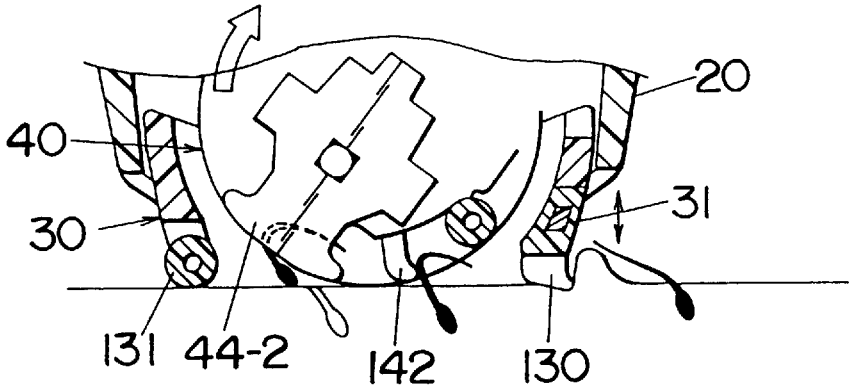

The front bar 31 of the skin guide frame 30 is formed with a series of comb projections 130 which come into contact with the skin for lifting and smoothing the hairs prior to plucking the hairs. The rear bar 32 is provided with a smooth roller 131 for facilitating the skin guide frame to move across the skin. The roller 131 is rotatably supported about a shaft 132 fixed to the rear bar 32. Each of the end bars 33 is provided intermediate its length with a cam projection 39 which is engageable with each of toothed wheel 69 formed on opposite axial ends of the carrier 41. As the plucking head 40 rotates or swings about the shaft 42, the cam projection 39 rides up and down the teeth of the wheel 69, as shown in FIGS. 6A and 6B, so that the end bar 33 acts as a pawl to thereby vibrate the front bar 31 in a direction, as indicated by an arrow in FIG. 5, i.e., in the direction generally perpendicular to the surface of the skin. The resulting vibrations are applied as mechanical stimuli to the skin from which the hair are being plucked, thereby masking the pain of plucking the hair to alleviate the pain. Thus, the front bar 31 is defined as a vibrator which provides the mechanical stimuli through the comb projections 130 to the skin as the plucking head 40 is advanced across the skin with the front bar 31 located forwardly of the plucking head 40, as shown in FIGS. 7A to 7C. Thus, the vibrator i e., the front bar 31 provides vibrations to the skin during or just before plucking the hair to stimulate Meissner's corpuscle or Pacinian corpuscle to activate the gate control path for alleviating the pain. The vibration is set to have an optimum amplitude and frequency which are determined respectively by the engaging amount of the cam projection 39 and the toothed wheel 69 and by the tooth pitch of the toothed wheel 69. In order to reduce mechanical friction between the cam projection 39 and the wheel 69, at least one of these members is made as a freely rotating member. As shown in FIGS. 7A to 7C, comb fins 142 are formed on the carrier 41 between the guide roller 141 and the pinching blades 44-1 and 44-2 along the circumference of the plucking head 40 so as to guide the hairs smoothly in between the blades.

Figure 8:
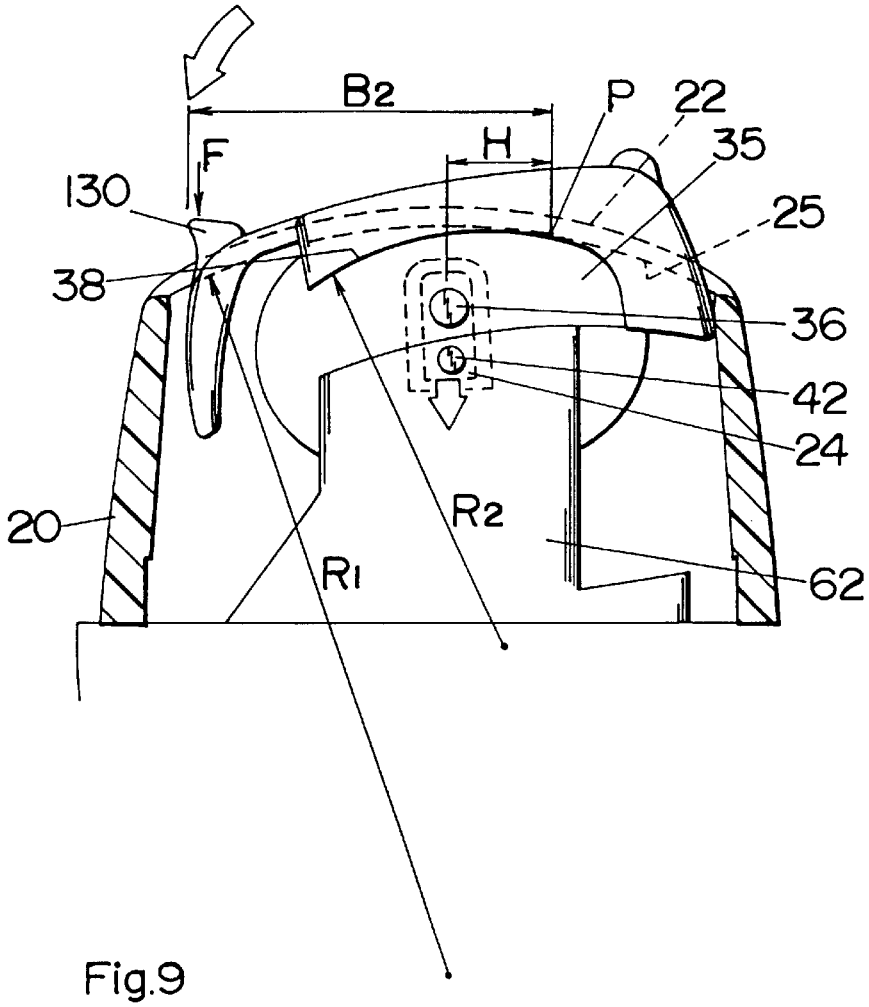
FIG. 8 is a side section showing a combination swing and depression movement of the skin guide frame.

It should be noted here that each of the bearing projection 35 on opposite end of the skin guide frame 30 is shaped to have a curved upper surface 38 which is urged against an inner curved surface 25 of an end flange 22 of the head frame 20, as best shown in FIG. 8, by the action of the coil spring 100. The curved upper surface 38 of the bearing projection 35 has a radius of curvature $R_2$ which is less than a radius of curvature $R_1$ of the inner curved surface 25 of the head frame 20 so that the bearing projection 35 is engaged with the inner curved surface 25 of the head frame only at a point of contact P which moves along the inner curved surface 25 as the front bar 31 is depressed. That is, when no depression force acts on the front bar 31, as shown in FIG. 5, the guide frame 30 is kept in a neutral position as being urged upwardly together with the plucking head 40 by the coil spring 100 where the point of contact P lies on a vertical plane passing through the axis of the pins 36 as well as the shaft 42 and through a portion at which the guide frame 30 receives the upward bias through the plucking head 40, leaving a distance $B_1$ between the front bar 31 and the point of contact P (although not seen in FIG. 5). As a depression force F is applied to the front bar 31 as a result of the that front bar 31 is pressed against the skin, as shown in FIG. 8, the point of contact P moves away by a distance of H from the vertical plane. Consequently, the guide frame 30 is allowed to swing about thus moved point of contact P relative to the head frame 20 with increased distance $B_2$ between the front bar 31 and the point of contact P, which accompanies a corresponding depressive movement of the plucking head 40. That is, as the front bar 31 is depressed, it swings about the moving point of contact P defining a swing axis parallel to the shaft 42 of the plucking head 40 with attendant depressive movement of the plucking head 40. With such combination of the swinging and depression movements, the front bar, i.e., vibrator 31 can be kept in an optimum contact with the skin for alleviation of the pain. It is noted in this connection that the pins 36 on the opposite ends of the guide frame 30 are loosely and slidably engaged with the grooves 24 in the head frame 20 to allow the above combination movement of the guide frame 30.

Figure 9:
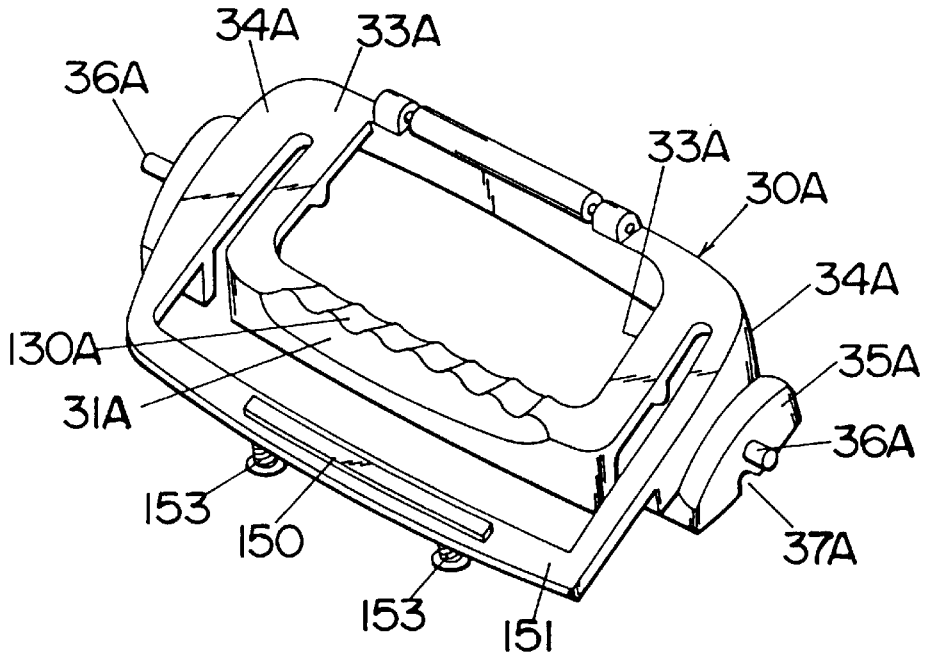
FIG. 9 is a perspective view of an alternative skin guide frame used in a modification of the depilating device.
Figure 10:
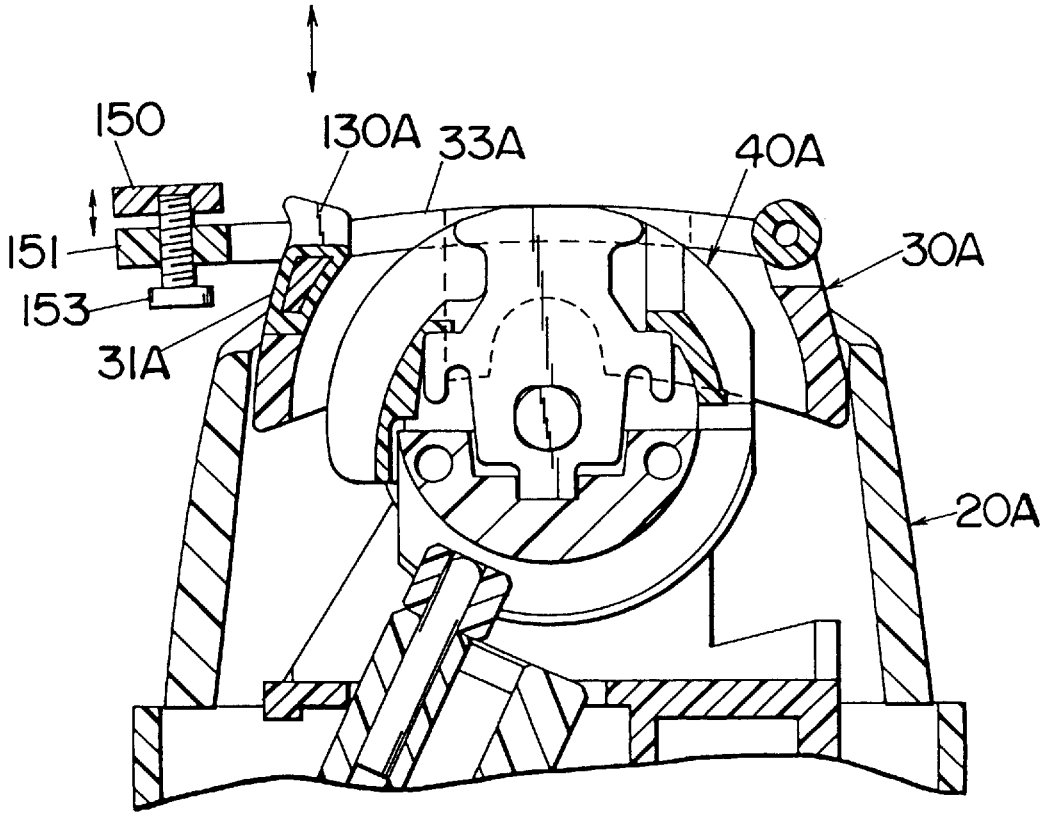
FIG. 10 is a side section showing the skin guide frame of FIG. 9.

FIGS. 9 and 10 illustrate a modified guide frame 30A which is identical to We above guide frame 30 except for a restrictor provided forwardly of the front bar, i.e., vibrator 31 to restrict the effect of the vibrations to be transmitted to the skin. Like parts are designated by like numerals with a suffix letter of "A". The restrictor comprises an elongate plate 150 mounted centrally on a jaw 151 which extends integrally from the end supports 34A. The plate 150 projects on the jaw 151 to abut against the skin forwardly of the vibrator 31A in the moving direction of the plucking head 40A, thereby restricting the extent at which the vibrator 31 applies the mechanical stimuli to the skin, i.e., the amplitude of the vibrations applied to the skin. Particularly with the presence of the restrictor 150, it is readily possible to prevent the vibrator 31A from being over-pressed against the skin which would otherwise reduce the vibration amplitude to an ineffective level or even stop the vibration. The restrictor 150 are connected to the jaw 151 through adjusting screws 153 which vary the projection amount of the restrictor 150 for obtaining an optimum effect of the restrictor.

Figure 11:
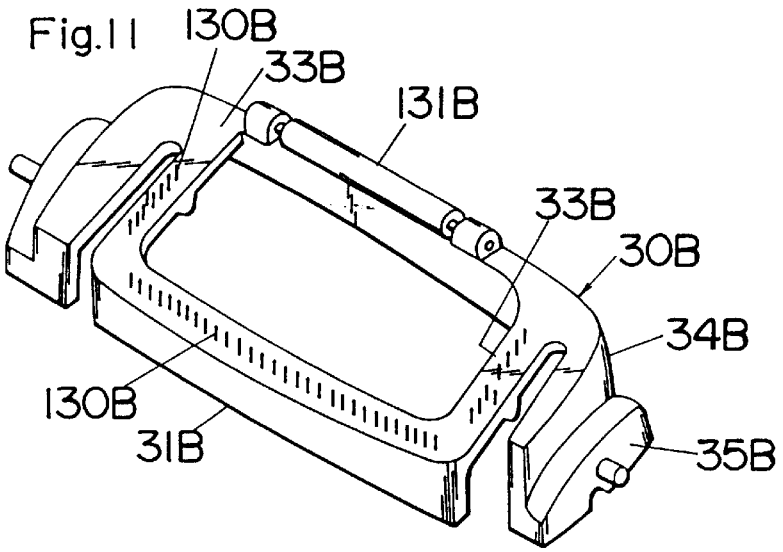
FIGS. 11, 12, and 13 are perspective views respectively showing other skin guide frame used in further modifications of the depilating device.
Figure 12:
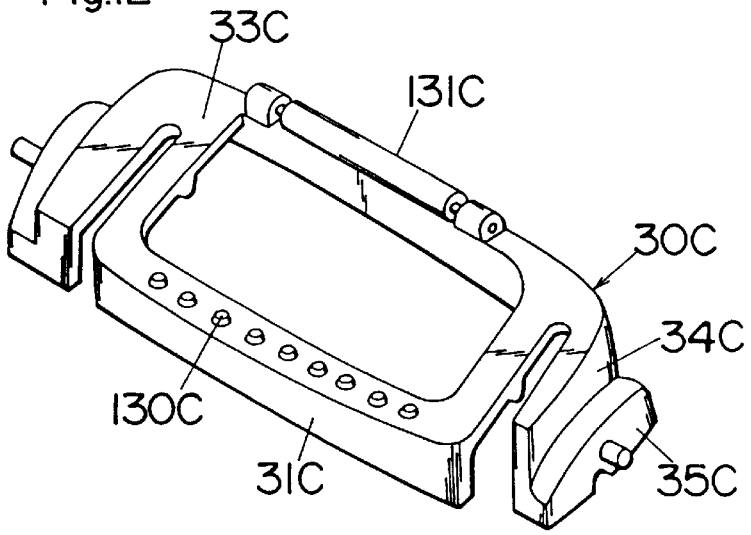

FIGS. 11 and 12 illustrate further modified skin guide frames which are similar to the above guide frame but have different kinds of projections for transmitting the mechanical stimuli to the skin. The modified skin guide 30B of FIG. 11 is formed on the front bar 31B as well as on the end bars 33B with bristles 130B, while the skin guide f e of FIG. 12 is formed on the front bar 31C with studs 130C. Like parts are designated by like numerals with suffix letters "B" and "C", respectively in FIGS. 11 and 12.

Figure 13:
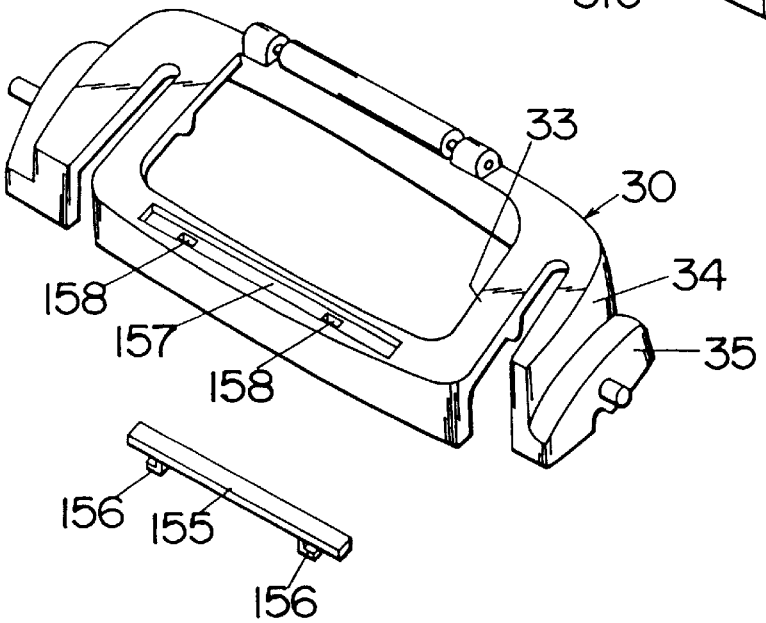

FIG. 13 illustrate a still further modified skin guide frame 30D which is similar to the above guide frame 30 except that a detachable applicator 155 is provided on the front bar 31D. Like parts are designated by like numerals with a suffix letter of "D". The applicator 155 has a pair of hooks 156 which are detachably engageable into corresponding notches 158 in the bottom of a recess 157 formed in the upper surface of the front bar 31D. When assembled, the applicator 155 is received in the recess 157 to apply the vibrations to the skin. With the use of a variety of detachable applicators of different stimulus transmitting configurations, the user can select one of the applicators on her preference.

Figure 14:
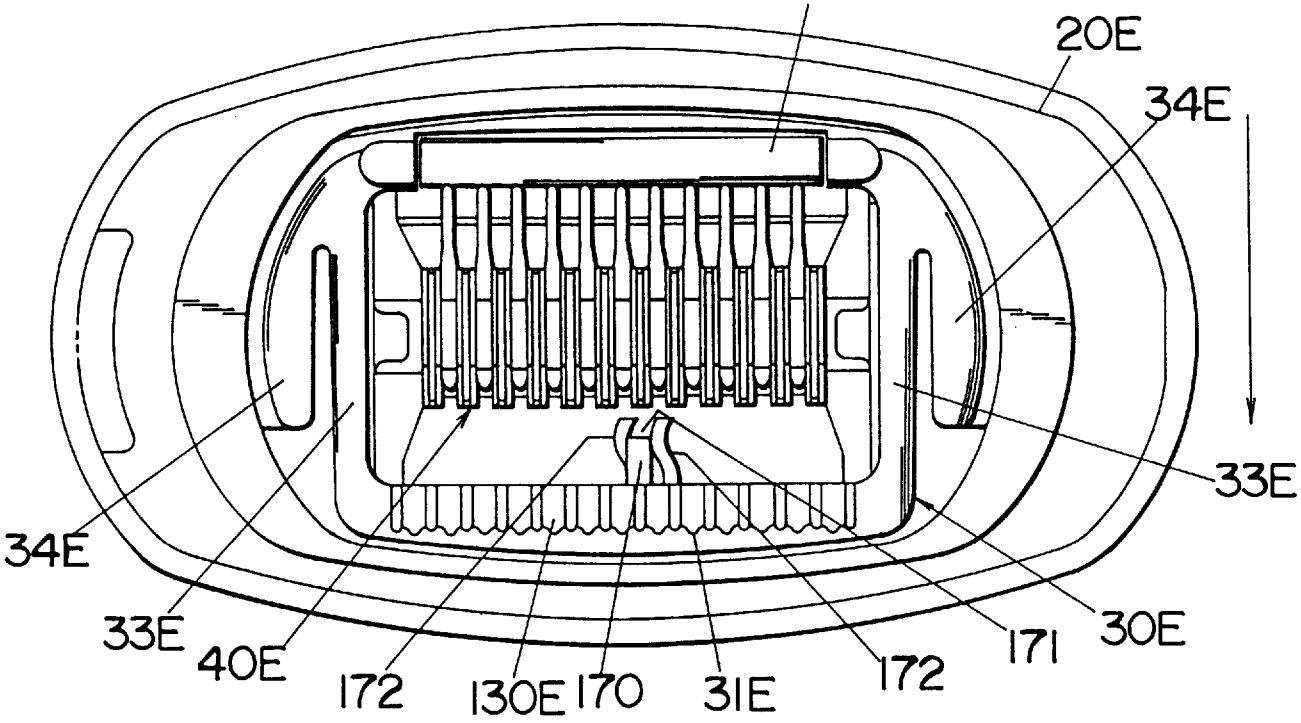
FIG. 14 is a top view of a depilating device in accordance with a second embodiment of the present invention.
Figure 15:
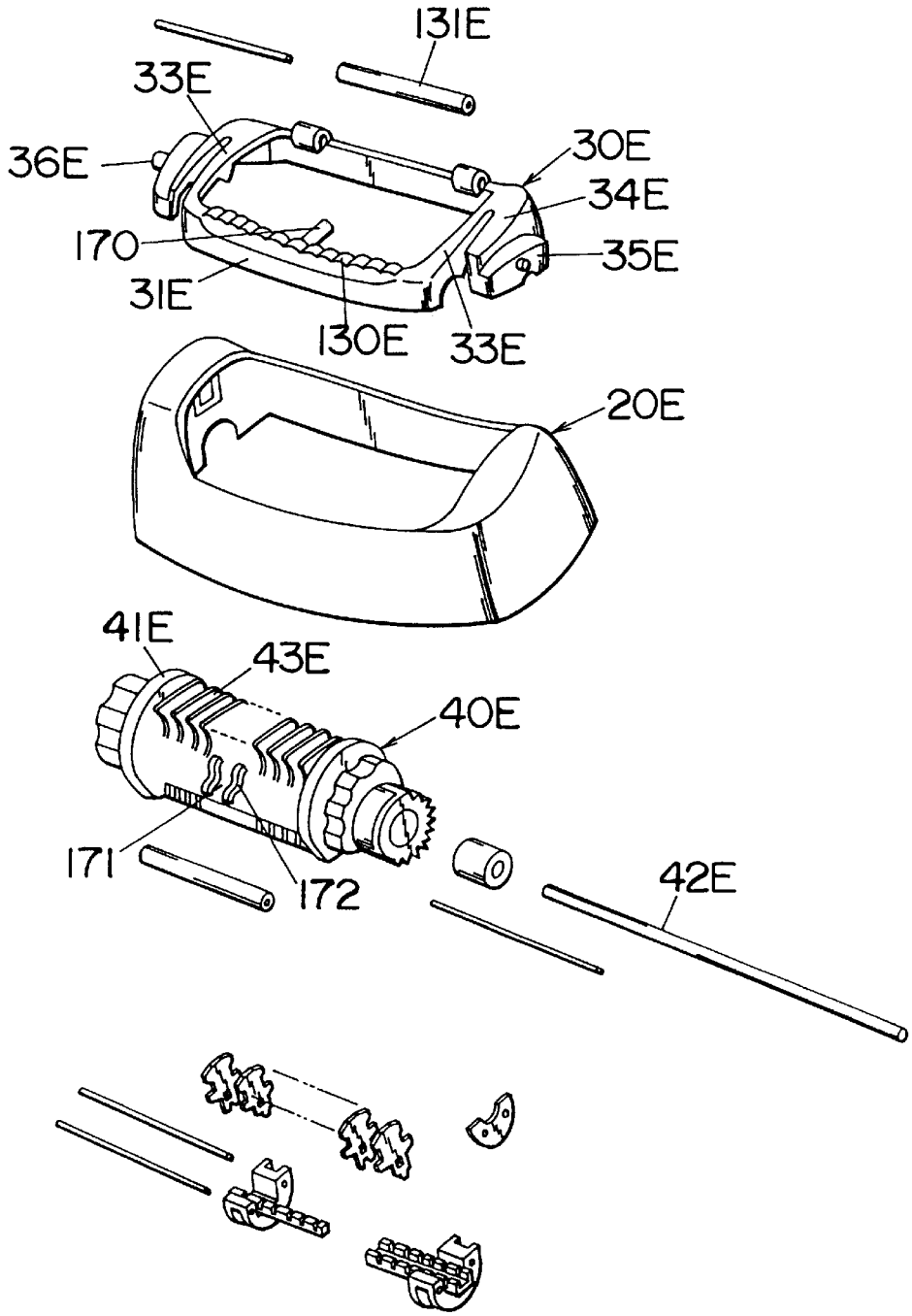
FIG. 15 is an exploded perspective view of the device of FIG. 14.
Figure 16:
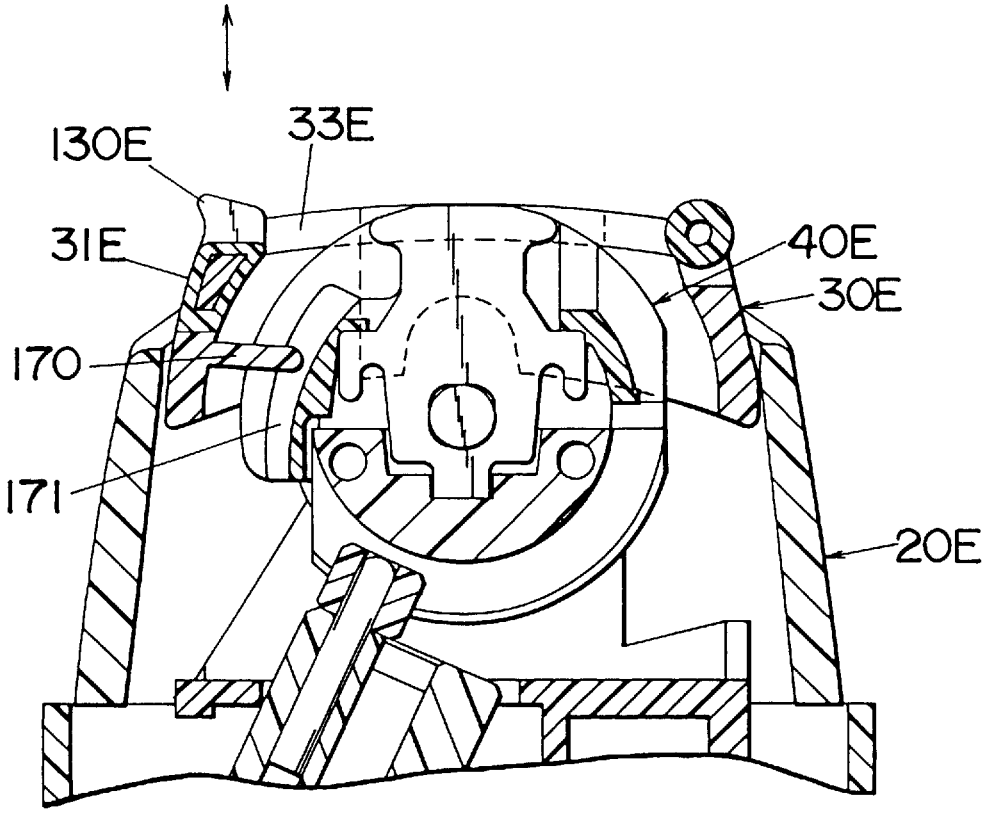
FIG. 16 is a side section of the above device.

Second Embodiment <FIGS. 14 to 16>

Referring to FIGS. 14 to 16, there is shown a second embodiment of the present invention which is identical to the first embodiment except that skin guide frame 30E includes a vibrator 31E which gives lateral vibrations in addition to the above vibrations acting in a direction generally perpendicular to the skin surface. Like parts are designated by like numerals with a suffix letter of "E". The opposite end bars 33E of the guide frame 30E which are connected only at their rear ends to the end support 34E permit the front bar or vibrator 31E move horizontally in the lengthwise direction of the front bar 31E in addition to the vertical direction. Projecting inwardly from the center of the front bar 31E is a follower pin 170 which is engaged into a spiral track 171 defined between a pair of guide rails 172 formed on the carrier 41E at a portion circumferentially spaced from the fixed pinching blades 43E. As the carrier 41E or the plucking head 40E swings about the axis of the shaft 42E, the follower pin 170 is guided along the spiral track 171 to vibrate the front bar 31E also in the lengthwise direction thereof, thereby applying the lateral vibrations to the skin simultaneously with the afore-mentioned vibrations for further enhancing the effect of applying the mechanical stimuli to the skin. It is noted in this respect that the lateral vibration thus given is selected to have a small vibration amplitude which do not bring about any unpleasant skin rubbing.

Third Embodiment <FIGS. 17 to 21>

A depilating device in accordance with a third embodiment is identical in structure and operation to the first embodiment except that a vibration roller 160 with stimulus projections is mounted on a like skin guide frame 30F. Like parts are designated by like numerals with a suffix letter of "F". The vibration roller 160 comprises a rotation shaft 162 carrying a plurality of bristles 161 extending radially therefrom over a length of the shaft and an eccentric weight 163 at one axial end of the shaft 162. The rotation shaft 162 is supported by bearings in the skin guide frame 30F and is driven by an incorporated motor 70F so that the vibration roller 160 rotates about the axis of the shaft 162 in parallel with a swing axis about which the plucking head 40F oscillates for plucking the hairs in the same maimer as explained in the first embodiment. Due to the provision of the eccentric weight 163, the mass center of the whole roller 160 is displaced from the rotation axis of the shaft 162 so that the roller 160 will vibrate as it is driven to rotate, thereby giving mechanical vibratory motion with which the bristles 161 can apply the mechanical stimuli to the skin. Instead of using the eccentric weight 163, the bristles or the like stimulus projections are arranged around the shaft 162 unevenly to give an offset center of mass displaced from the rotation axis of the shaft 162.

The skin guide fame 30F is held on the plucking head 40F which is floatingly supported to a housing 10F by means of a coil spring 100F so that the guide frame 3OF is capable of being depressed together with the plucking head 40F against the bias of the coil spring 100F. The floatingly support mechanism permits the skin guide frame itself to vibrate relative to the head frame as the roller 160 is driven to rotate, thereby applying the resulting vibrations to the skin. Further, the guide frame 30F is made to swing relative to the plucking head 40F in the same manner as in the first embodiment, i.e., swing with attendant depression of the plucking head 40F, as a result of a front end bar 31F being pressed against the skin. Alternately, the guide frame may be made to swing independently of the depression movement of the plucking head.

Figure 18:
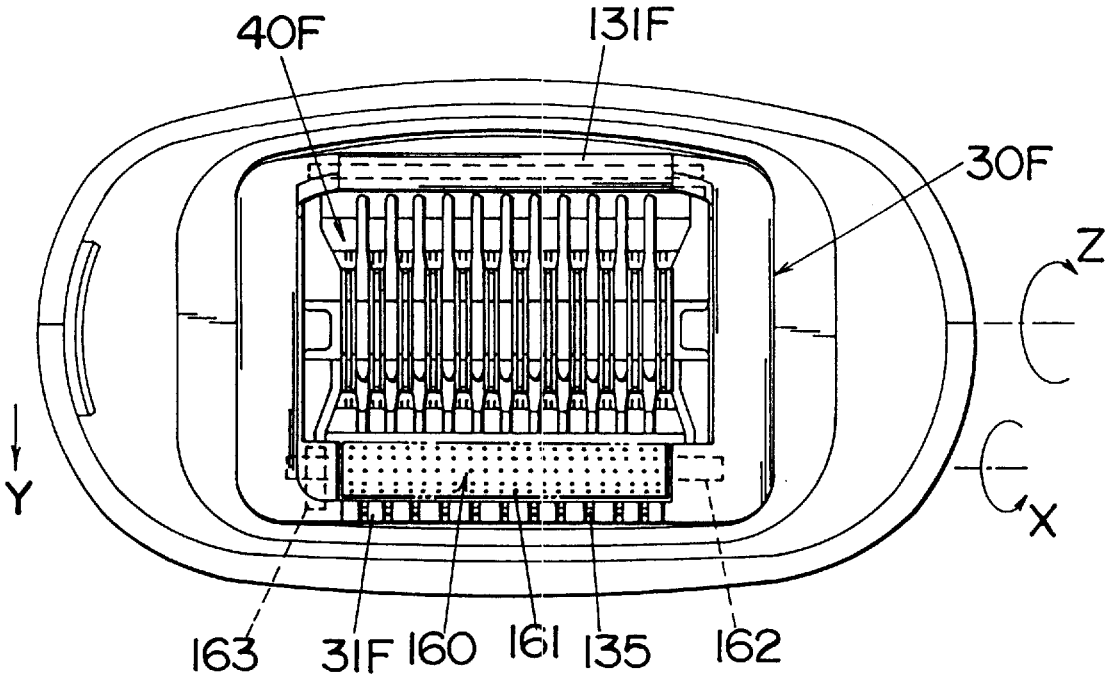
FIG. 18 is a top view of the above device.
Figure 19:
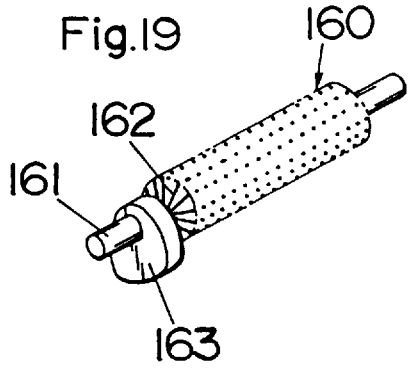
FIG. 19 is a perspective view of a vibration roller utilized in the above device.
Figure 21:
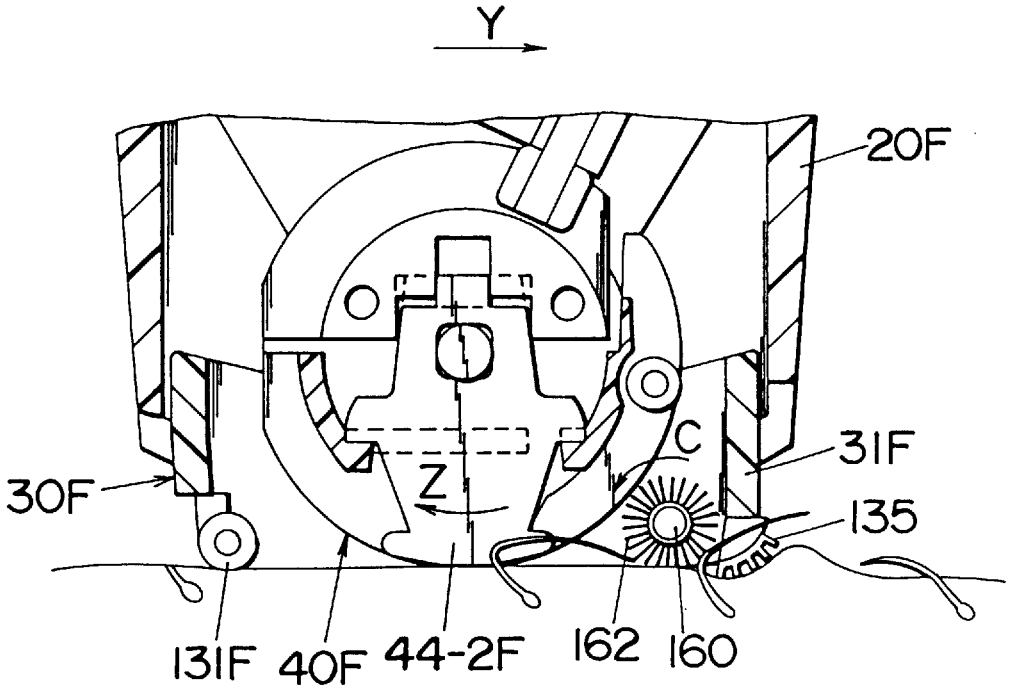
FIG. 21 illustrates the hair plucking operation with the aid of the roller.
Figure 22:
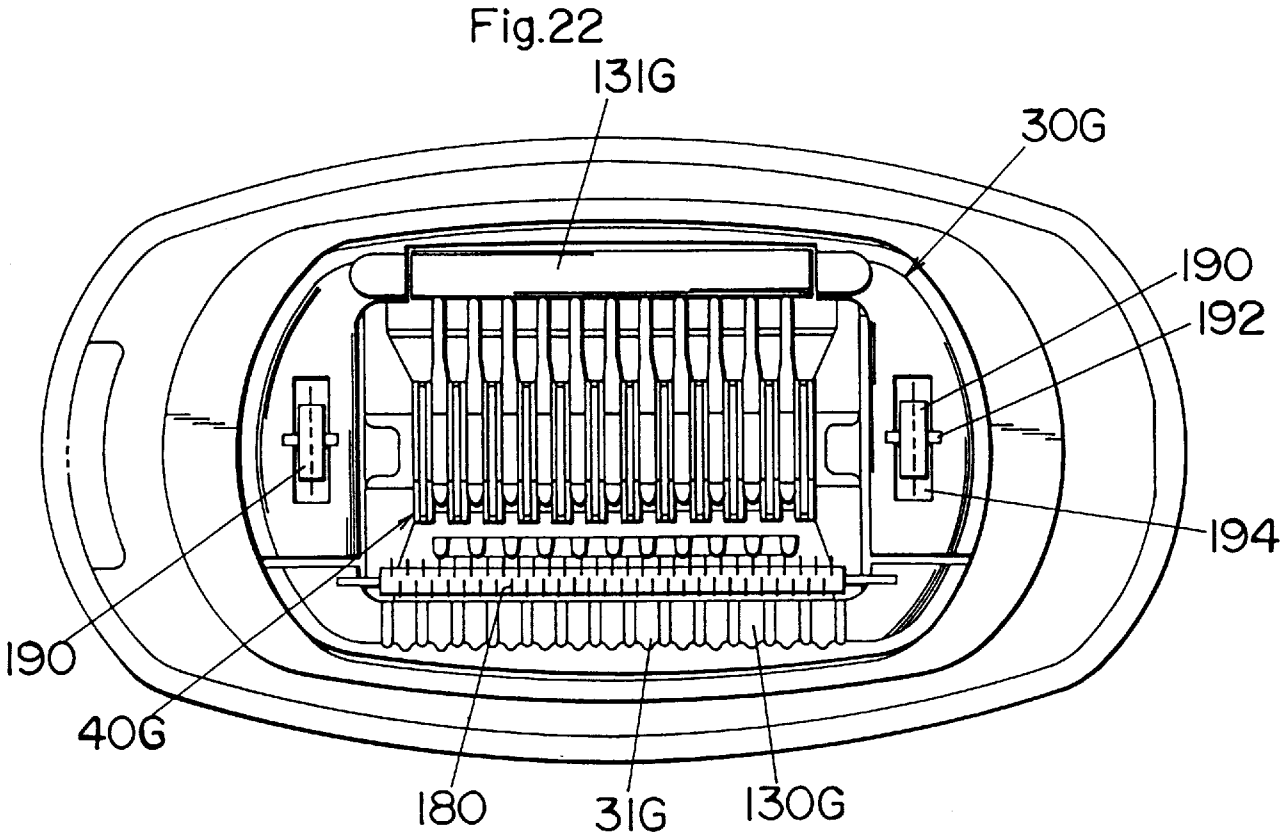
FIG. 22 is a top view of a depilating device in accordance with a fourth embodiment of the present invention.
Figure 23:
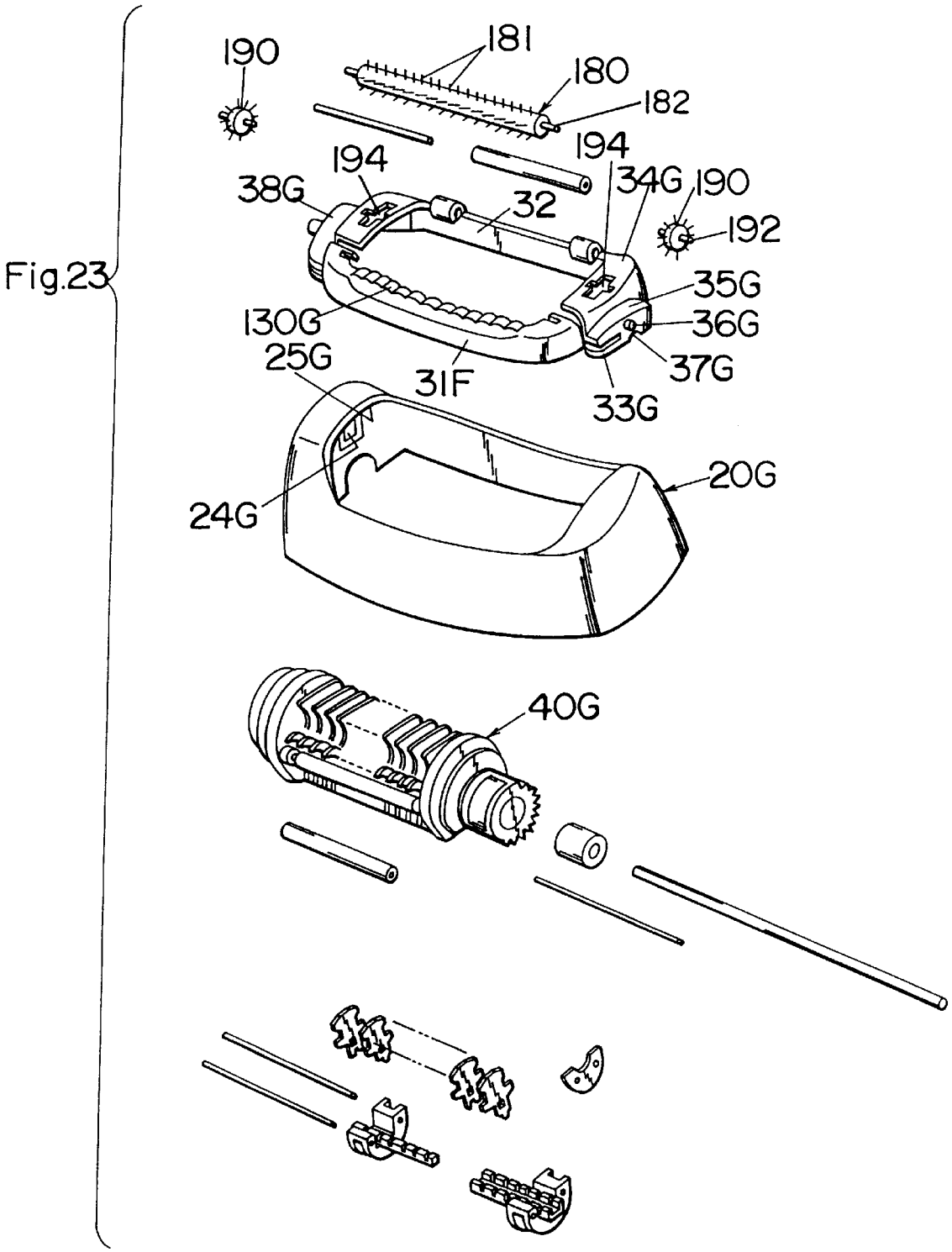
FIG. 23 is an exploded perspective view of the device of FIG. 22.

The vibration roller 160 is mounted between the front bar 31F and the plucking head 40F with its rotation axle 162 supported in corresponding bearing slots in the guide frame 30F, as shown in FIG. 18. The front bar 31F is formed with fins 135 which act to stretch the skin prior to plucking the hairs therefrom, as shown in FIG. 21. A smooth roller 131F is held on a rear bar 32F of the frame 30F for rolling contact with the skin to guide the plucking head smoothly on the skin.

Figure 17:
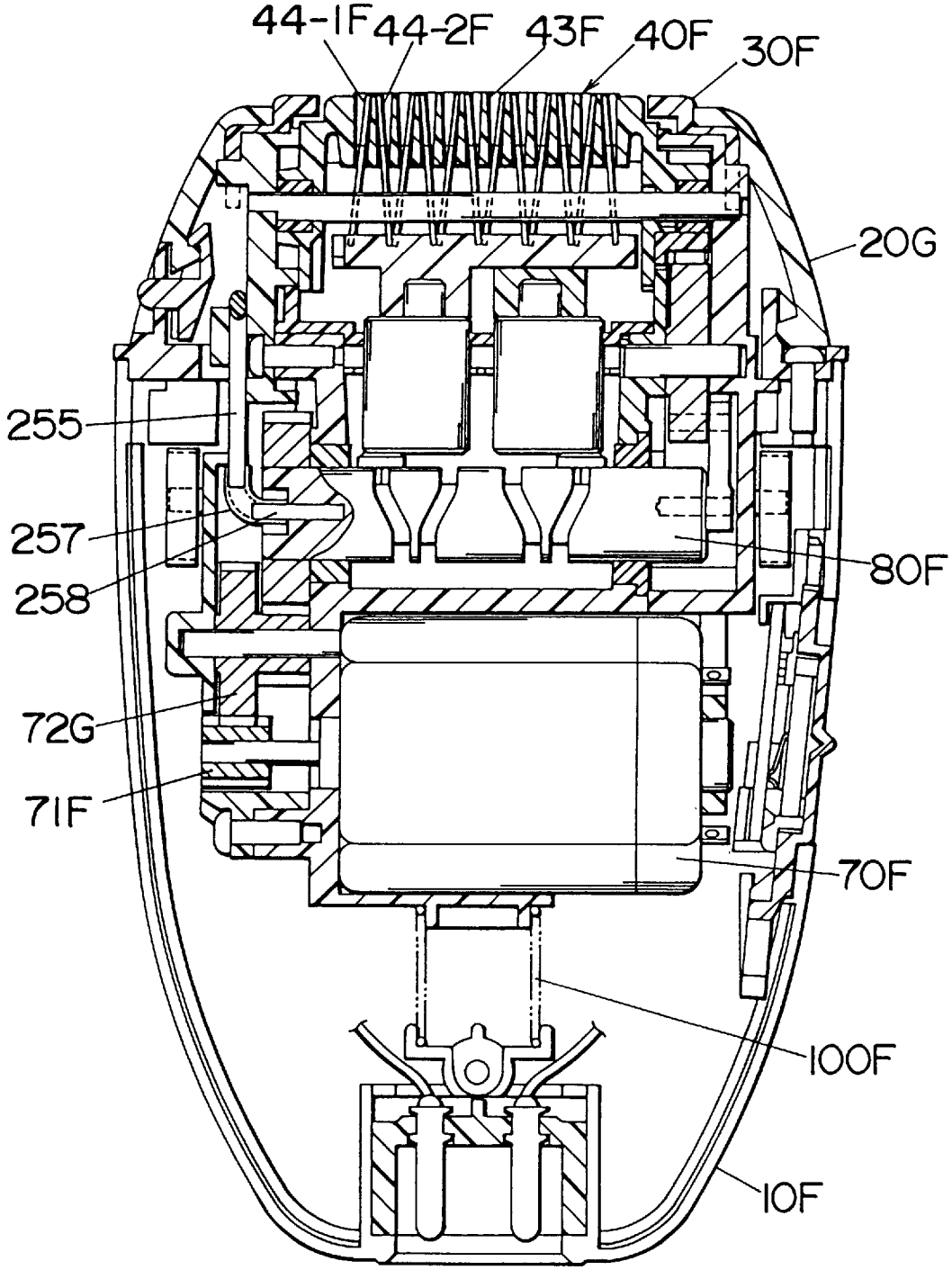
FIG. 17 is a front vertical section of a depilating device in accordance with a third embodiment of the present invention.
Figure 20:
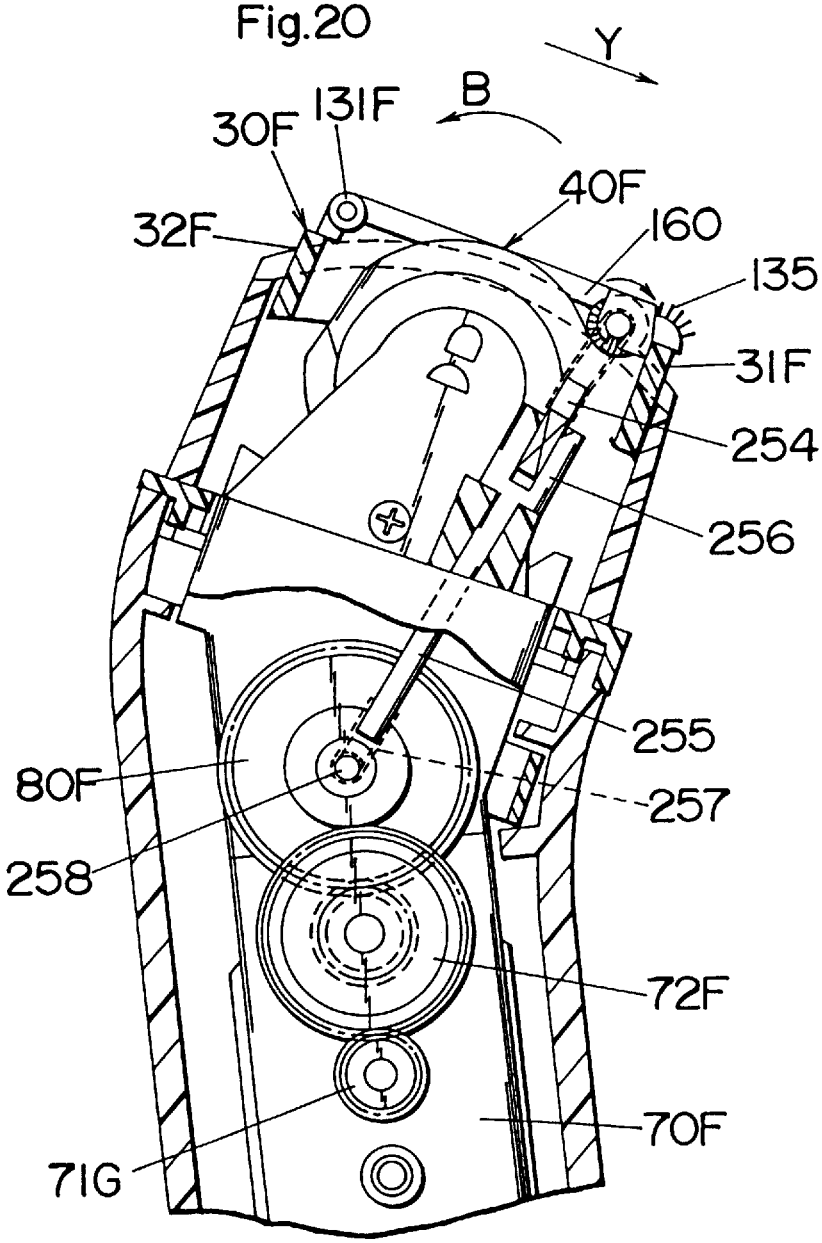
FIG. 20 is a side section of the top of the device for illustration of a drive mechanism of driving a roller on top of the device.

As shown in FIGS. 17 and 20, the vibration roller 160 is drivingly connected to a positive-return cam 80F through an upper link 254 and a lower link 255 so that it is driven to rotate by the incorporated motor 70F which drives the positive-return cam. That is, the vibration roller 160 has one axial end connected through a universal joint 253 to the upper link 254 of which lower end is detachably and slidably engaged into a socket 256 of the lower link 255 to allow the vibration roller 160 to move relative to the head frame. The lower end of the lower link 255 is then connected through another universal joint 257 to a drive pin 258 projecting from the axial end of the positive-return cam 80F. The roller 160 thus connected to the motor is driven thereby to rotate in a direction, as indicated by an arrow X in FIGS. 20 and 21, which opposes the advancing direction Y of the plucking head 40F as well as a direction Z in which the plucking head 40F swings for plucking the hair from the skin. Since the roller 160 is driven to rotate while manipulating the plucking head to advance over the skin, the bristles 161 of the roller 160 can intermittently apply the mechanical stimuli to skin from which the hairs are just being plucked, thereby alleviating the hair plucking pain. The above relation between the directions X, Y, and Z of the roller 160 and the plucking head 40F are found to be effective for alleviating the pain. Particularly, in addition to applying the vibratory mechanical vibrations, the roller 160 rotating in the direction X acts to successfully raise the hairs lying on the skin or curled hairs so that the pinching blades 44-1F and 44-2F can catch the root of the hairs and pluck the hair in the direction of its growth with a reduced pain.

Although not disclosed in the figures, the skin guide frame 30F of this embodiment may be formed to have a movable front bar as seen in the previous embodiments and the vibration roller 160 may be supported to be movable together with the movable front bar for a limited extent relative to the other portion of the skin guide frame.

Fourth Embodiment <FIGS. 22 to 28>

A depilator device in accordance with a fourth embodiment of the present invention is similar in structure and in operation to the first embodiment except that at least one roller is mounted adjacent to a like plucking head to apply the mechanical stimuli to the skin as it is caused to rotate by contact with the skin. Like parts are designated by like numerals with like numerals with a suffix letter of "G". The roller 180 is disposed in generally parallel with and immediately behind a front bar 31G of a like skin guide frame 30G to be freely rotatable about an axis of a shaft 182 the opposite ends of which are supported to bearing slots 183 in the opposite ends of the front bar 31G. The roller 180 carries a plurality of radially projecting bristles 181 arranged circumferentially and axially over a corresponding length of the plucking head 40G. A pair of additional rollers 190 are mounted respectively on the guide frame 30G axially outwardly of the plucking head 40G. Each of the additional rollers 190 is also supported to be freely rotatable about an axis of a shaft 192 and carries a plurality of radially projecting bristles 191. These rollers 180 and 190 are made into rolling contact with the skin and caused to rotate as the plucking head 40G is manipulated to move across the skin, during which the bristles 181 and 191 apply the mechanical stimuli to the skin for alleviating the pain of plucking the hairs.

The skin guide frame 30G is made of a plastic material into a unitary structure of a generally rectangular configuration composed of the front bar 31G, rear bar 32G, and opposed end support 34G integrally connecting the front and rear bars. The front bar 31G is connected to the end supports 34G at its opposite ends respectively through resilient members 33G so that the front bar 31G is allowed to move vertically within a limited extent relative to the other portion of the guide frame 30G. The end support 34G is provided with a recess 194 for receiving the additional roller 190. The roller 180 supported by the front bar 31G is allowed to be depressed together with the front bar 31G relative to the other portion of the guide frame 30G for a limited event after which it is depressed together with the guide frame 30G and the plucking head 40G relative to the head fame 20G. In this manner, the roller 180 is made to easily follow the skin configuration. The front bar 31G is formed with comb projections 130G for smoothing and raising the hairs prior to plucking the same. It is noted here that the plucking head 40G is floatingly supported by the same spring mechanism as utilized in the first embodiment so as to be depressed relative to the head frame 20G and that the skin guide frame 30G is held on the plucking head 40G to receive the upward bias from the spring mechanism so as to be depressed together with the plucking head 40G.

Figure 27A:
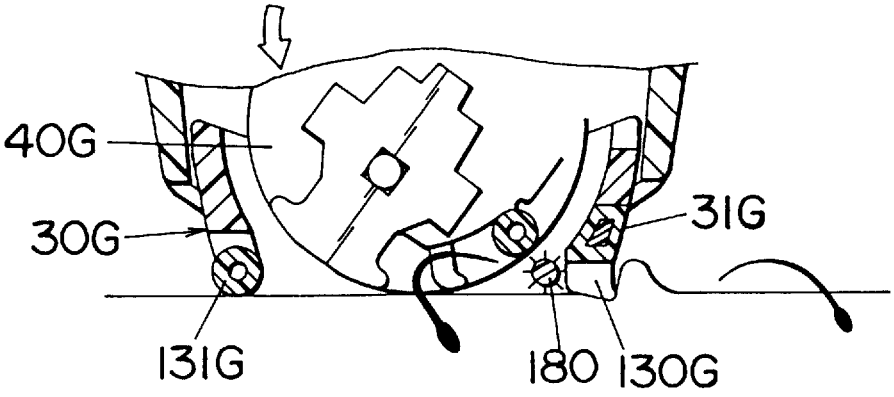
FIGS. 27A, 27B, and 27C show a hair plucking operation with the aid of a roller with stimulus projections carried by the skin guide frame.
Figure 27B:
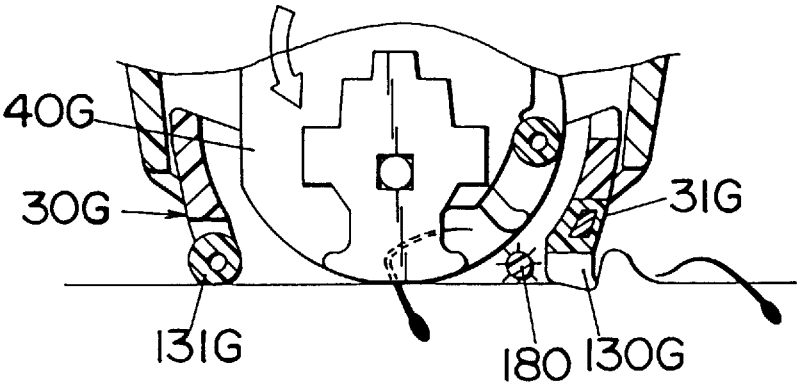
Figure 27C:
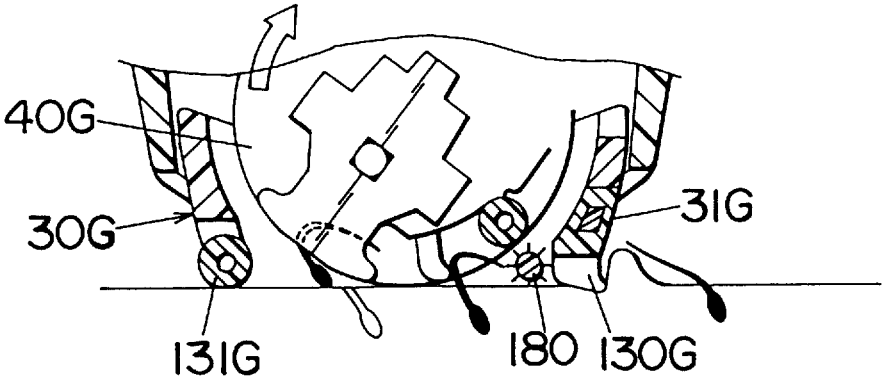
Figure 28:
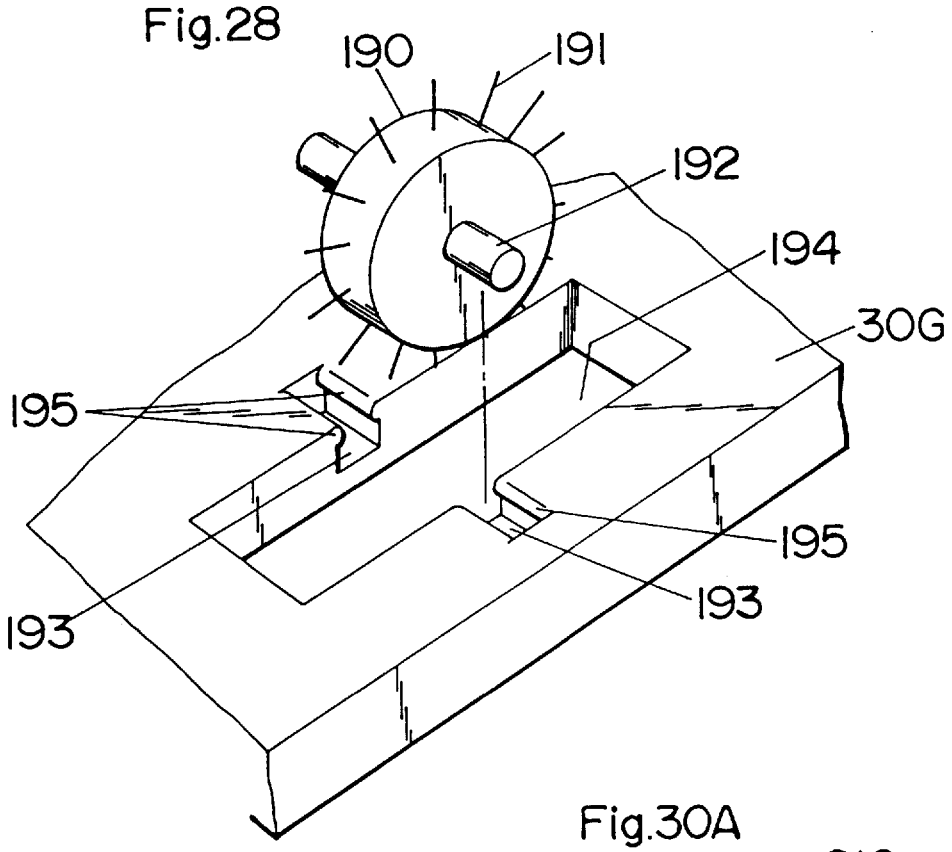
FIG. 28 is an exploded perspective view of a mechanism of detachably mounting one of the rollers to the skin guide frame.

The rear bar 32G carries a freely rotatable smooth roller 131G which comes into rolling contact with the skin behind the plucking head 40G for smoothly guiding the plucking head in the moving direction. FIGS. 27A to 27C illustrate the sequence of the plucking operation in which the plucking head 40G moves from left to right in the figures while swinging about the longitudinal axis thereof as indicated by arrows for plucking the hairs. During this operation, the roller 180 and the additional rollers 190 (although not seen in these figures) are kept in rolling contact with the skin so that the bristles 181 and 191 thereof can apply the mechanical stimuli to the skin for masking the pain of plucking the hairs.

Figure 26A:
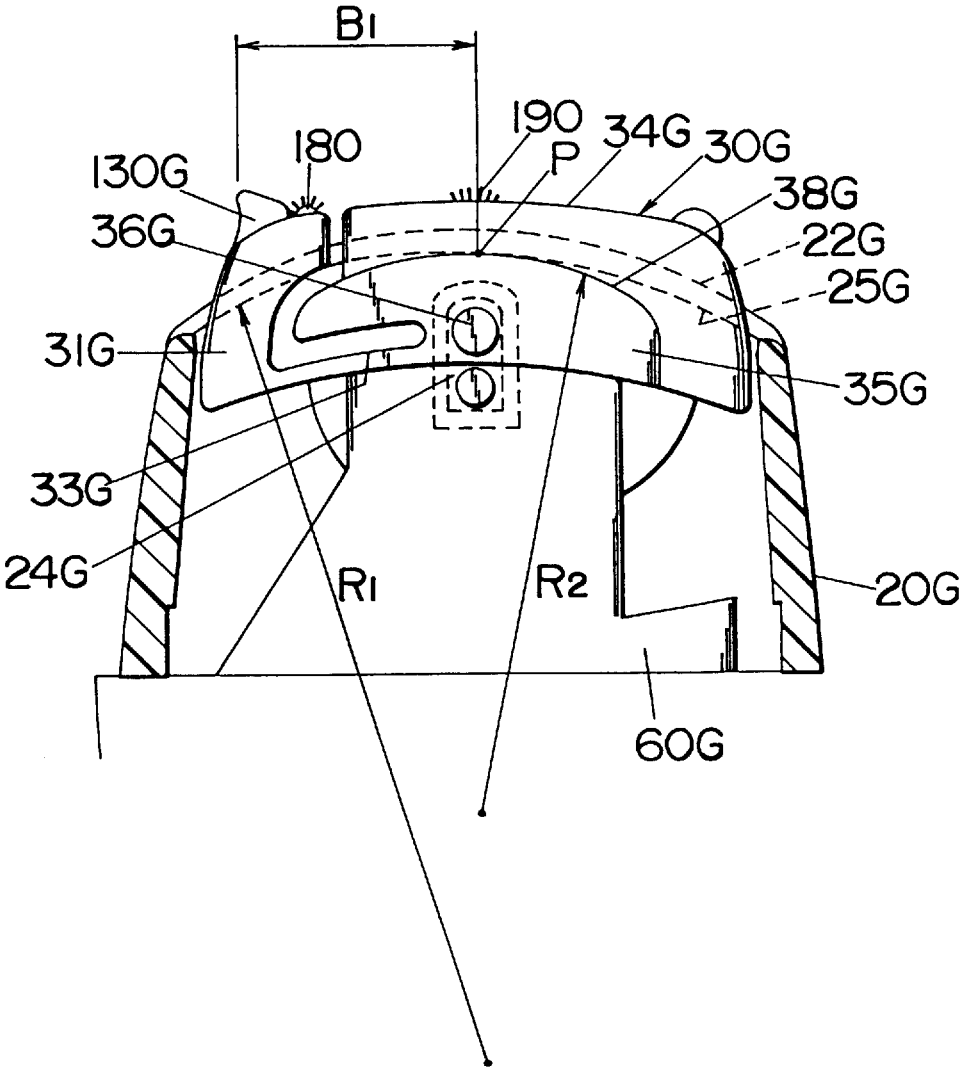
FIGS. 26A and 26B are side sections showing a combination swing and depression movement of the skin guide frame.
Figure 26B:
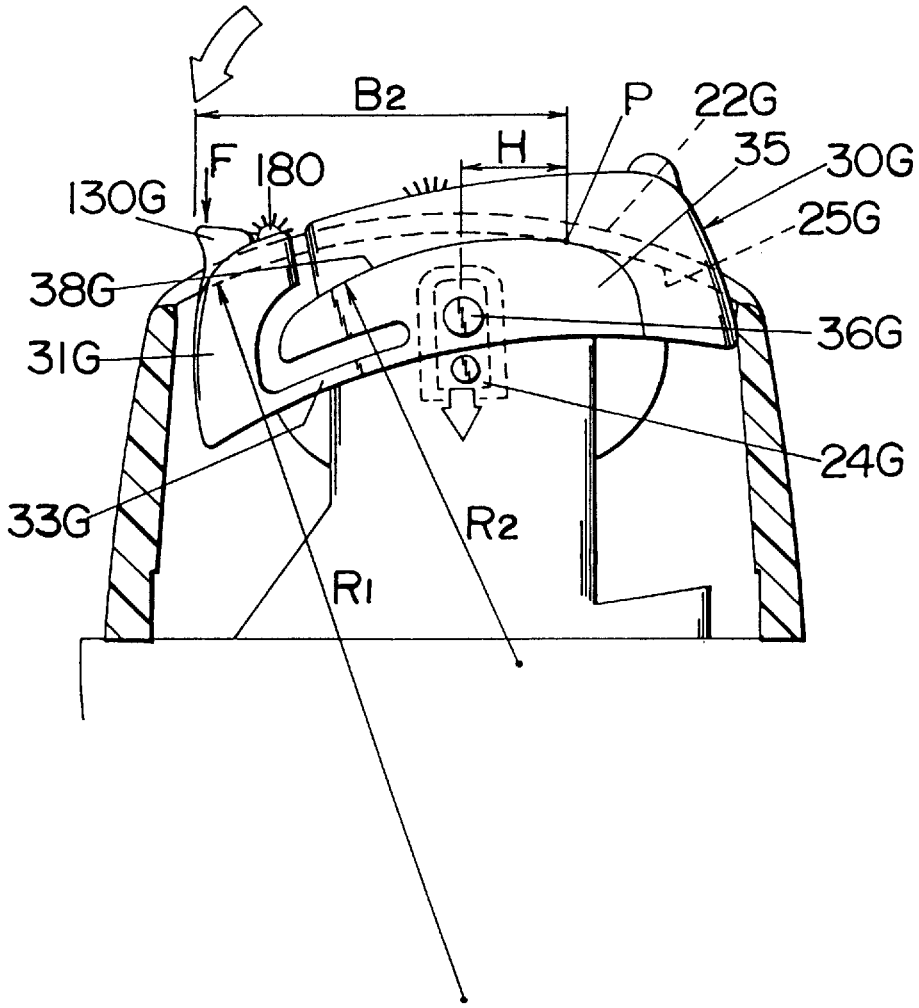

Also in this embodiment the guide frame 30G is formed on opposite ends thereof with like bearing projections 35G which include individual pins 36G for loose engagement into corresponding vertical grooves 24 in the opposite inner end surface of the head frame 20G. Further, the bearing projections 35G are formed in their lower ends with recesses 37G into which an upper end 62G of a like chassis 60G carrying the plucking head 40G engages so that the guide frame 30G is floatingly supported and is capable of being depressed together with the plucking head 40G. Each of the bearing projections 35G has a curved upper surface 38G which is urged against an inner curved surface 25G of an end flange 22G of the head frame 20G, as best shown in FIG. 26A, by the bias of a coil spring (not shown) acting to urge the plucking head 40G. The curved upper surface 38G of the bearing projection 35G has a radius of curvature $R_2$ which is less than a radius of curvature $R_1$ of the inner curved surface 25G of the head frame 20G so that the bearing projection 35G is engaged with the inner curved surface 25G of the head frame only at a point of contact P which moves along the inner curved surface 25G as the front bar 31G is depressed. That is, when no depression force acts on the front bar 31G as shown in FIG. 26A, the guide frame 30G is kept in a neutral position as being urged upwardly together with the plucking head 40 where the point of contact P lies on a vertical plane passing through the axis of the pin 36G and through the point at which the guide frame 30G receives the upward bias from the plucking head 40G, leaving a distance $B_1$ between the front bar 31G pressed against the skin and the point of contact P. As a depression force F is applied to the front bar 31G as a result of being pressed against the skin, as shown in FIG. 26B, the point of contact P moves away by a distance of H from the vertical plane. With this consequence, the guide frame 30G is allowed to swing about thus moved point of contact P relative to the head frame 20G with increased distance $B_2$ between the front bar 31G and the point of contact P, which accompanies a corresponding depressive movement of the plucking head 40G. That is, as the front bar 31G is depressed together with the roller 180, the guide frame 30G swings about the moving point of contact P with attendant depressive movement of the plucking head 40G. With such combination of the swinging and depression movements, the front bar 31G and the roller 180 can be kept in an optimum contact with the skin for alleviation of the pain. It is noted in this connection that the pins 36G on the opposite ends of the guide frame 30G are loosely and slidably engaged with the grooves 24G in the head frame 20G to allow the above combination movement of the guide frame 30G.

Figure 24:
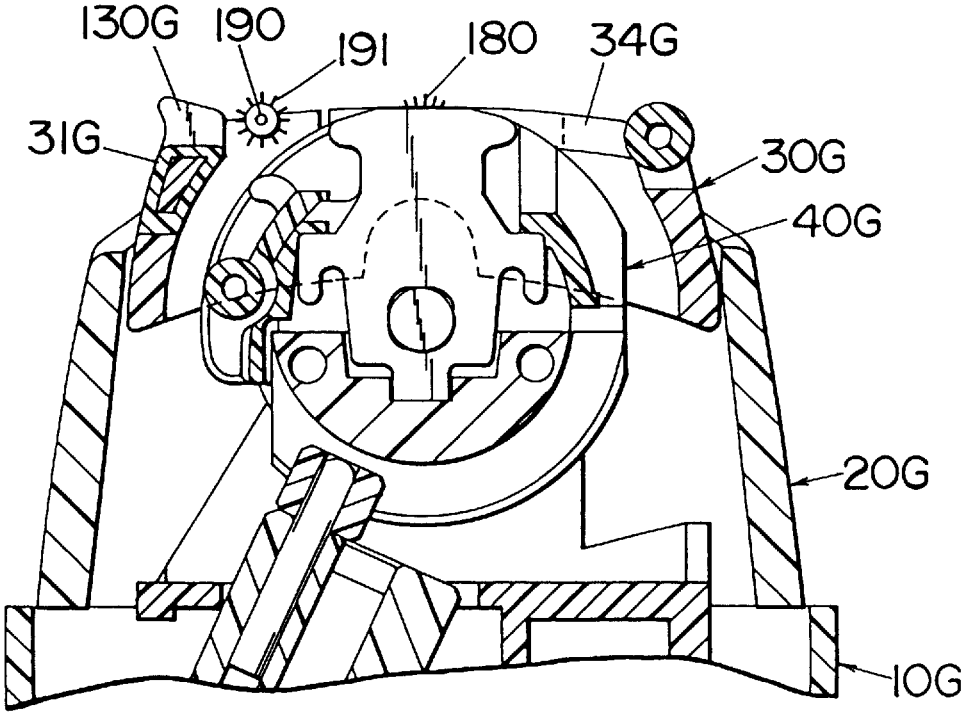
FIG. 24 is a side section of a plucking head and a skin guide frame of the device.
Figure 25:
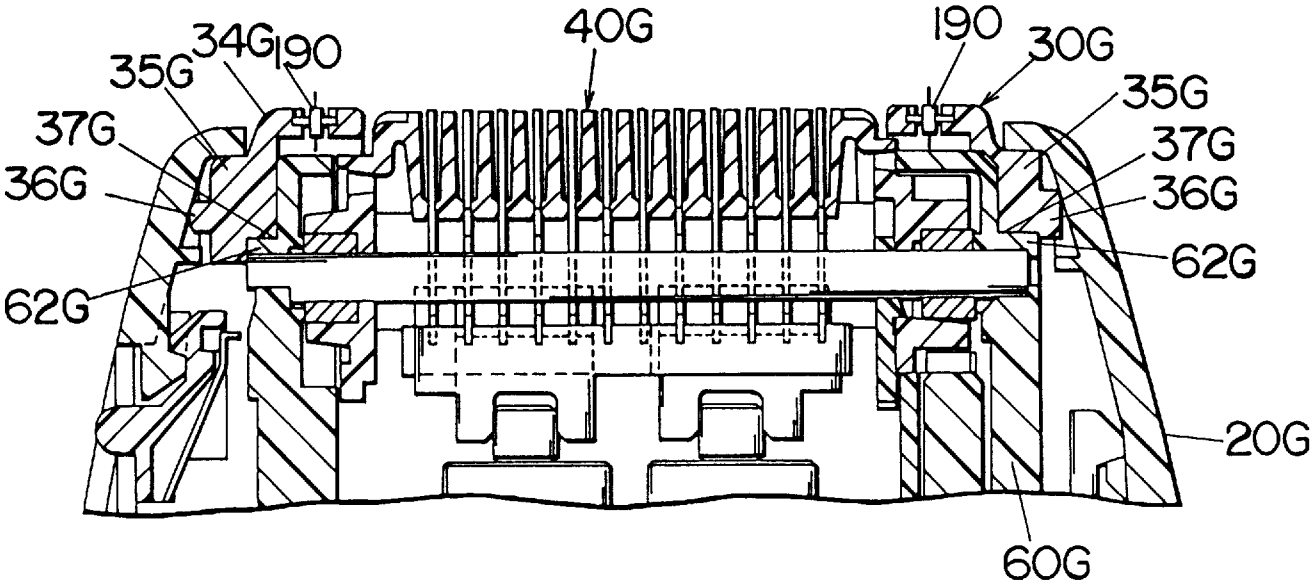
FIG. 25 is a front vertical section of the plucking head.

The rollers 180 and 190 are preferred to be detachably mounted to the guide frame 30G so that the user can select optimum rollers from a set of rollers of providing different stimuli on her preference. FIG. 24 illustrates one scheme for the detachable mounting of the rollers 190, although it is equally applicable for the roller 180. The roller 190 is received in the recess 194 with its shaft 192 retained in bearing slots 193. The bearing slot 193 is formed in its upper end with latches 195 which project inwardly to define an entrance of a width slightly narrower than the diameter of the shaft 192. Due to resilient deformability inherently given to the plastic-made guide frame 30G, the shaft 192 is allowed to pass through the entrance and is locked in the bearing slot 193 behind the latches 195 for easy attachment of the roller 190. Likewise, the detachment of the roller can be made easily by the use of the resilient deformability. Although not shown in the figure, it is possible to make the bearing slots 193 deep enough and to provide additional latches intermediate its depth to latch the shaft 192 in the slots at different depth. With this design, it is made easy to adjust the projection amount of the roller or the bristles on the guide frame for selecting strong or weak mechanical stimuli from the rollers.

Figure 29A:
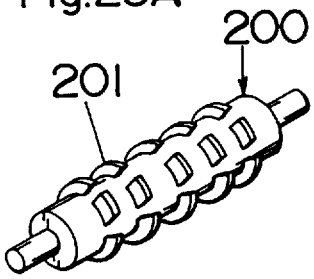
FIGS. 29A and 29B are perspective and sectional views of a first alternative roller which may be utilized in the above depilating device.
Figure 29B:
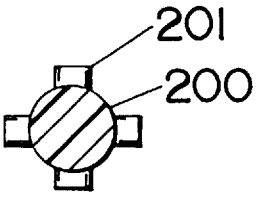

Although the rollers with the bristles are shown in the above, the present invention is not limited thereto and may include rollers of different configurations as explained below. A roller 200 in accordance with a first modification is shown in FIGS. 29A and 29B and comprises a plurality of elastic fins 201 spaced circumferentially and axially of the roller. The fin is made thinner toward its tip than at the root to be given elastic deformability for enhanced skin contact effect.

Figure 30A:
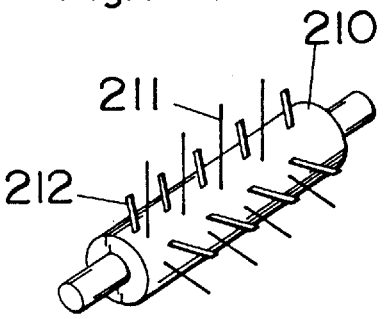
FIGS. 30A and 30B are perspective and sectional views of a second alternative roller which may be utilized in the above depilating device.
Figure 30B:
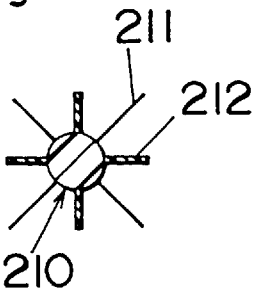

FIGS. 30A and 30B show a second modification of roller 210 with a combination of bristles 211 and elastic projections 212 which project radially with different radial lengths to define stimulus projections of applying different stimuli to the skin. The bristles 211 and the elastic projections 212 alternate in the circumferential direction and arranged along the axial length of the roller. The elastic projection may be a bundle of the bristles. With the use of the stimulus projections of different characteristics, it is possible to apply different kinds of mechanical stimuli to the skin for enhancing the alleviation of the hair plucking pain.

Figure 31A:
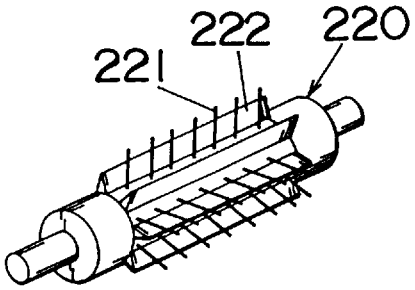
Figure 31B:
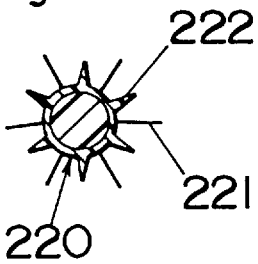

FIGS. 31A and 31B show a third modification of roller 220 with another combination of bristles 221 and elastic fins 222 which alternate in the circumferential direction. The elastic fins 222 is continuous over the substantial axial length of the roller 220 to apply the mechanical stimulus different from the bristles to the skin as it rotates on the skin.

Figure 32A:
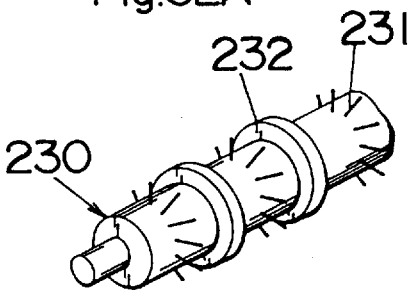
FIGS. 32A and 32B are perspective and sectional views of a fourth alternative roller which may be utilized in the above depilating device.
Figure 32B:
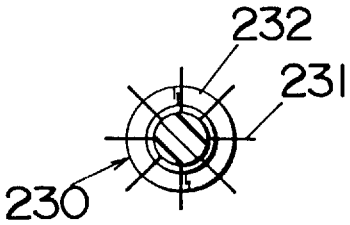

FIGS. 32A and 32B show a fourth modification of roller 230 with a further combination of bristles 231 and rings 232 which alternate in the axial direction of the roller and apply different mechanical stimuli to the skins respectively.

Figure 33:
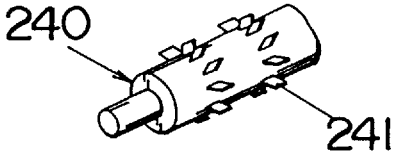
FIG. 33 is a perspective view of a fifth alternative roller which may be utilized in the above depilating device.

FIG. 33 shows a fifth modification of roller 240 with elastic fins 241 which are spaced circumferentially and axially of the roller with the width thereof aligned in the axial direction.

We claim:

1. A hand-held depilating device for plucking hairs from the skin of a user, said depilating device comprising:

a housing having top and bottom ends adapted to be grasped by the hand of the user;

a head frame attached to said top end of said housing;

a plucking head mounted at the top end of said housing for plucking the hairs from the skin;

stimulator means mounted adjacent to said plucking head for providing mechanical stimuli to the skin while said plucking head operates to pluck the hairs said stimulator means comprising a vibrator which provides vibrations to said skin as said mechanical stimuli;

wherein stimulus control means is attached to said vibrator to keep said mechanical stimuli at substantially a uniform level irrespective of varying depressive force applied against said vibrator.

2. The hand-held depilating device as set forth in claim 1, wherein said vibrator comprises a vibration roller which is rotatably supported to the top of said housing and is driven by an incorporated motor to rotate about a rotation axis eccentric from a mass center of the roller so that it vibrates to give said mechanical stimuli.

3. The hand-held depilating device as set forth in claim 1, wherein said vibrator vibrates in a direction perpendicular to a general surface of the skin.

4. The hand-held depilating device as set forth in claim 1, wherein said stimulus control means comprises a mechanism for floatingly supporting said vibrator on said housing to make said vibrator capable of being depressed.

5. The hand-held depilating device as set forth in claim 4, wherein said vibrator is carried on a skin guide frame which is floatingly supported by said housing so as to be capable of being depressed.

6. The hand-held depilating device as set forth in claim 1, wherein said stimulus control means comprises a mechanism for swingably supporting said vibrator to said head frame so that said vibrator can swing about a swing axis.

7. The hand-held depilating device as set forth in claim 6, wherein said vibrator is carried on a skin guide frame which is floatingly supported by said housing so as to be capable of being depressed.

8. The hand-held depilating device as set forth in claim 7, wherein said skin guide frame is engaged at a point of contact on a rounded portion of said head frame, said point of contact defining said swing axis about which said skin guide frame can swing, said point of contact being caused to move along said rounded portion as said skin guide frame swings with an attendant depression of said plucking head.

9. The hand-held depilating device as set forth in claim 1, wherein said stimulus control means comprises a restrictor which is provided adjacent to said vibrator for restricting the amount of said vibrations to be applied to the skin.

10. The hand-held depilating device as set forth in claim 9, wherein said restrictor includes means for variably adjusting said amount of said vibrations.

11. The hand-held depilating device as set forth in claim 1, wherein said vibrator includes a skin contact member which is detachable from said vibrator.

12. A hand-held depilating device for plucking hairs from the skin of a user, said depilating device comprising:

a housing having top and bottom ends adapted to be grasped by the hand of the user;

a head frame attached to said top end of said housing;

a plucking head mounted on said top end of said housing for plucking the hairs from the skin;

stimulator means mounted on top of said housing adjacent to said plucking head for providing mechanical stimuli to the skin while said plucking head operates to pluck the hairs;

wherein said stimulator means comprises a roller with a plurality of stimulus projections, said roller being rotatably mounted to said head frame for rolling contact with the skin as said depilating head is manipulated across the skin so that said stimulus projections provide said mechanical stimuli to the skin, whereby said mechanical stimuli is kept at a substantially uniform level irrespective of varying depressive force applied against said roller.

13. The hand-held depilating device as set forth in claim 12, wherein said stimulus projections are in the form of bristles projecting radially from said roller.

14. The hand-held depilating device as set forth in claim 12, wherein said roller is floatingly supported by said housing so as to be capable of being depressed.

15. The hand-held depilating device as set forth in claim 14, wherein said roller is carried on a skin guide frame which is floatingly supported by said housing so as to be capable of being depressed.

16. The hand-held depilating device as set forth in claim 12, wherein said roller is pivotally supported by said head frame to be swingable about a swing axis.

17. The hand-held depilating device as set forth in claim 12, wherein an adjusting means is provided to adjust a projection amount of said stimulus projections from the top of the housing.

18. The hand-held depilating device as set forth in claim 12, wherein said roller is detachably mounted to said head frame.

19. The hand-held depilating device as set forth in claim 12, wherein said plucking head is floatingly supported by said housing to be capable of being depressed, a skin guide frame being provided to surround said plucking head and comprise a main body which is connected to said plucking head to be capable of being depressed together therewith and a front guide which is movably supported to said main body for limited displacement relative to said main body, and said roller being supported by said front guide.

20. The hand-held depilating device as set forth in claim 19, wherein said skin guide frame is supported by said head frame so that it can swing about a swing axis while being depressed together with said plucking head.

21. The hand-held depilating device as set forth in claim 20, wherein said skin guide frame is engaged at a point of contact on a rounded portion of said head frame, said point of contact defining said swing axis about which said skin guide frame can swing, said point of contact being capable of moving along said rounded portion as said skin guide frame swings and is depressed.

22. A hand-held depilating device for plucking hairs from the skin of a user, said depilating device comprising:

a housing having top and bottom ends adapted to be grasped by the hand of the user;

a head frame attached to said top end of said housing;

a plucking head mounted at the top end of said housing for plucking the hairs from the skin;

a vibrator mounted adjacent to said plucking head for providing mechanical stimuli to the skin in the form of vibrations while said plucking head operates to pluck the hairs;

wherein said vibrator is floatingly supported on said housing to make said vibrator capable of being depressed, whereby said mechanical stimuli can be kept at a substantially uniform level irrespective of varying depressive force applied against said vibrator.

23. A hand-held depilating device for plucking hairs from the skin of a user, said depilating device comprising:

a housing having top and bottom ends adapted to be grasped by the hand of the user;

a head frame attached to said top end of said housing;

a plucking head mounted at the top end of said housing for plucking the hairs from the skin;

a vibrator mounted adjacent to said plucking head for providing mechanical stimuli to the skin in the form of vibrations while said plucking head operates to pluck the hairs;

wherein said vibrator is swingably supported on said head frame so that said vibrator can swing about a swing axis, whereby said mechanical stimuli can be kept at a substantially uniform level irrespective of varying depressive force applied against said vibrator.

* * * * *